US005695913A

United States Patent [19]

Nakamura et al.

[11] Patent Number: 5,695,913

[45] Date of Patent: Dec. 9, 1997

[54] PROCESS FOR THE FORMATION OF COLOR IMAGE

[75] Inventors: Koichi Nakamura; Koki Nakamura; Kiyoshi Takeuchi, all of Minami-ashigara, Japan

[73] Assignee: Fuji Photo Film Co., Ltd., Kanagawa, Japan

[21] Appl. No.: 608,509

[22] Filed: Feb. 28, 1996

[30] Foreign Application Priority Data

Feb. 28, 1995 [JP] Japan ..... HEI. 7-063587

[51] Int. Cl.[6] ..... G03C 7/30

[52] U.S. Cl. ..... 430/373; 430/414; 430/415; 430/418; 430/448; 430/566; 430/943

[58] Field of Search ..... 430/373, 414, 430/415, 418, 943, 448, 566

[56] References Cited

U.S. PATENT DOCUMENTS

| | | | |
|---|---|---|---|
| 2,424,256 | 7/1947 | Schmidt et al. | 430/380 |
| 4,094,682 | 6/1978 | Fujiwhare et al. | 430/943 |
| 4,481,268 | 11/1984 | Bailey et al. | 430/17 |
| 4,845,016 | 7/1989 | Ishikawa et al. | 430/372 |
| 5,324,624 | 6/1994 | Twist | 430/943 |

FOREIGN PATENT DOCUMENTS

| | | |
|---|---|---|
| 0 545 491 | 6/1993 | European Pat. Off. . |
| 0 565 165 A1 | 10/1993 | European Pat. Off. . |
| 3706823 | 9/1987 | Germany . |
| 77851 | 4/1986 | Japan . |
| 259249 | 11/1986 | Japan . |
| A-3111844 | 5/1991 | Japan . |
| 6-332128 | 12/1991 | Japan . |
| WO 91/12567 | 8/1991 | WIPO . |
| WO 92/09009 | 5/1992 | WIPO . |

*Primary Examiner*—Hoa Van Le
*Attorney, Agent, or Firm*—Birch, Stewart, Kolasch & Birch, LLP

[57] ABSTRACT

A process for the formation of a color image which comprises the steps of: exposing to light a silver halide light-sensitive material comprising a support having thereon at least one light-sensitive emulsion layer, and developing said light-sensitive material to form a color image, wherein said light-sensitive material comprises at least one dye-forming coupler and at least one coloring reducing agent represented by formula (I) and is intensified with a solution containing hydrogen peroxide or a compound releasing hydrogen peroxide to form an intensified image:

$$R^{11}—NH—NH—X—R^{12} \quad (I)$$

wherein $R^{11}$ represents an aryl group or a heterocyclic group; $R^{12}$ represents an alkyl group, an alkenyl group, an alkynyl group, an aryl group, or a heterocyclic group; and X represents $—SO_2—$, —CO—, —COCO—, —CO—O—, $—CO—N(R^{13})—$, —COCO—O—, $—COCO—N(R^{13})—$, or $—SO_2—N(R^{13})—$, in which $R^{13}$ represents a hydrogen atom, an alkyl group, an alkenyl group, an alkynyl group, an aryl group, or a heterocyclic group.

12 Claims, No Drawings

PROCESS FOR THE FORMATION OF COLOR IMAGE

FIELD OF THE INVENTION

The present invention relates to a process for the intensification of an image on a light-sensitive material comprising a light-sensitive silver halide emulsion, a dye-forming coupler and a coloring reducing agent with an intensifier containing hydrogen peroxide. The present invention also relates to a process for the formation of an intensified color image which comprises imagewise exposing a silver halide light-sensitive material having a low silver halide content (hereinafter sometimes referred to as "low silver content light-sensitive element") to light, and then intensifying the image with the foregoing intensifier free of p-phenylenediamine derivative and an image intensification process which can provide a sufficient image density in a short period of time. More particularly, the present invention relates to a color image formation process which requires no desilvering process and enables simplified processing causing little environmental pollution.

BACKGROUND OF THE INVENTION

Many methods for processing a silver halide color light-sensitive material have been heretofore known which comprise developing a silver halide color light-sensitive material with a color developer containing a color developing agent, and then processing the silver halide color light-sensitive material with an intensifier containing an intensifying agent to intensify the image. As such an intensifying agent there has been known a peroxide, a halogenous acid, an iodoso compound or a cobalt (III) complex compound. Among these compounds, hydrogen peroxide is considered most preferred because of its high intensifying effect or little environmental pollution. Further, as a method for promoting the image intensification and accomplishing the simplification of processing there is disclosed a development and intensification process which comprises simultaneous execution of development and intensification in a combined developing and intensifying bath containing hydrogen peroxide and a color developing agent in *Bulletin of Society of Photographic Science and Technology of Japan*, vol. 51, No. 3, page 191 (1988), JP-B-61-48148 (The term "JP-B" as used herein means an "examined Japanese patent publication"), JP-B-63-20330, and JP-B-63-20332. Further, a method which comprises the use of a low silver content light-sensitive element having a high silver chloride content to rapidly provide an intensified image in an extremely small amount of silver salt is described in JP-A-3-111844 (The term "JP-A" as used herein means an "unexamined published Japanese patent application"). In accordance with these methods, even when a low silver content light-sensitive element having a drastically reduced silver content is used, a sufficient image density can be obtained, and a color image formation process requiring less processing baths is provided.

On the other hand, the combined developing and intensifying bath is disadvantageous in that hydrogen peroxide and the color developing agent undergo oxidation reaction and reduction reaction at the same time, fatiguing the processing solution and hence deteriorating the stability thereof. Therefore, it is necessary that the rate of exchange of processing solution be raised. This difficulty makes it necessary to supply a fresh solution in a large amount or use the processing solution in a throwaway manner.

A method which comprises the reduction of the amount of the combined developing and intensifying bath to be used to make up for this difficulty is described in JP-A-61-77851, and JP-A-3-11844. Further, a processing apparatus for developing and intensifying with a small amount of a processing solution is described in International Patent Publication Nos. WO91/12567 and WO92/09009.

However, the deterioration of the processing solution by the reaction of hydrogen peroxide with the color developing agent is essentially unavoidable. It still presents problems of variation of photographic properties due to liquid fatigue, increased stain due to the accumulation of oxidized color developing agent and a large amount waste liquid. Accordingly, it has been desired to develop a system which can overcome the deterioration of the liquid stability due to a continuous processing step or other processing steps to attain a drastic reduction of the amount of the processing solution and stabilized photographic properties. At the same time, a system causing extremely little environmental pollution has been keenly desired in the art.

When a silver halide light-sensitive material having a drastically reduced amount of silver is used in the conventional developing and intensifying method using a color developing agent and hydrogen peroxide in an attempt to obtain a sufficient color image, it presents problems of a large amount of waste liquid, variation of photographic properties with processing conditions and increased stain.

SUMMARY OF THE INVENTION

An object of the present invention is to provide a color image formation process with a silver halide light-sensitive material which employs a stable processing solution containing hydrogen peroxide to provide an intensified color image having little variation of photographic properties.

Another object of the present invention is to provide a color image formation process with a silver halide light-sensitive material which can drastically reduce the wasted amount of silver or other processing chemicals to lessen the load on the environment.

Other objects and effects of the present invention will be apparent from the following description.

The present inventors have made extensive studies of these problems. As a result, it has been found that the foregoing objects of the present invention can be accomplished by the following processes.

The present invention relates to a process for the formation of a color image which comprises the steps of: exposing to light a silver halide light-sensitive material comprising a support having thereon at least one light-sensitive emulsion layer, and developing the light-sensitive material to form a color image, wherein the light-sensitive material comprises at least one dye-forming coupler and at least one coloring reducing agent represented by formula (I) and is intensified with a solution containing hydrogen peroxide or a compound releasing hydrogen peroxide to form an intensified image:

$$R^{11}—NH—NH—X—R^{12} \quad (I)$$

wherein $R^{11}$ represents an aryl group or a heterocyclic group; $R^{12}$ represents an alkyl group, an alkenyl group, an alkynyl group, an aryl group, or a heterocyclic group; and X represents —$S_2$—, —CO—, —COCO—, —CO—O—, —CO—N($R^{13}$)—, —COCO—O—, —COCO—N($R^{13}$)—, or —$SO_2$—N($R^{13}$)—, in which $R^{13}$ represents a hydrogen atom, an alkyl group, an alkenyl group, an alkynyl group, an aryl group, or a heterocyclic group.

In a preferred embodiment of the present invention, the total coated amount of silver contained in all coating layers of the silver halide light-sensitive material is from 0.003 to 0.3 g/m$^2$.

In another preferred embodiment of the present invention, the silver halide light-sensitive material comprises at least one of an auxiliary developing agent and a precursor thereof.

DETAILED DESCRIPTION OF THE INVENTION

Examples of the system having a color developing agent or precursor thereof incorporated in a light-sensitive material are described in U.S. Pat. Nos. 2,507,114, 3,764,328, and 4,060,418, JP-A-56-6235, and JP-A-58-192031. However, these systems are disadvantageous in that these aromatic primary amines and precursors thereof are unstable and a low silver content light-sensitive element comprising such an aromatic primary amine or precursor thereof incorporated therein can enjoy only a small effect of intensifying image and is more liable to stain when subjected to intensification. Further, these systems are disadvantageous in that the color developing agent is accumulated in the intensifying bath after a continuous processing and thus are still liable to variation of photographic properties. Thus, the conventional color development system comprising a color developing agent incorporated therein can hardly exhibit a sufficient effect of intensifying image with hydrogen peroxide.

On the other hand, it was found that the incorporation of a coloring reducing agent of the present invention can unexpectedly provide a drastically intensified color image without having any of the foregoing disadvantages.

In other words, it was found that when an intensifying solution containing hydrogen peroxide is applied to a low silver content light-sensitive element containing a coloring reducing agent of the present invention and a coupler which has been exposed to light, an image having a high density and little stain can be surprisingly obtained even in a continuous processing process.

Further, it was found that the presence of an auxiliary developing agent or precursor thereof (such as incorporation in the light-sensitive material or in the alkali solution, preferably in the light-sensitive material) can further enhance the effect of intensifying image and the stability of the intensifying bath. Thus, the present invention has been accomplished.

Some of coloring reducing agents effective for the present invention are described in EP 0545491A1 and EP 0565165A1. However, these patents have no reference to the application of these coloring reducing agents to the development and intensification process as proposed by the present invention and the resulting effect.

The coloring reducing agent to be used in the present invention will be further described hereinafter.

The coloring reducing agent represented by formula (I) to be used in the present invention is a compound which directly reacts with an exposed silver halide to be oxidized, or undergoes oxidation-reduction reaction with an auxiliary developing agent oxidized with an exposed silver halide. The oxidation product of the coloring reducing agent reacts with a dye-forming coupler to form a dye. The structure of the coloring reducing agent represented by formula (I) will be further described hereinafter.

The aryl or heterocyclic group represented by $R^{11}$ may have substituents.

The aryl group represented by $R^{11}$ preferably has from 6 to 14 carbon atoms. Examples of the aryl group represented by $R^{11}$ include a phenyl group and a naphthyl group. The heterocyclic group represented by $R^{11}$ preferably include a saturated or unsaturated 5-, 6- or 7-membered ring containing at least one of nitrogen, oxygen, sulfur and selenium, more preferably, a saturated or unsaturated 5- or 6-membered ring containing from 1 to 3 atoms selected from nitrogen, oxygen and sulfur. The heterocyclic group may be condensed with benzene ring or heterocyclic ring. Examples of the heterocyclic group represented by $R^{11}$ include a furanyl group, a chenyl group, an oxazolyl group, a thiazolyl group, an imidazolyl group, a triazolyl group, a pyrrolidyl group, a benzoxazolyl group, a benzothiazolyl group, a pyridyl group, a pyridadyl group, a pyrimidinyl group, a pyrazinyl group, a triazinyl group, a quinolinyl group, an isoquinolinyl group, a phthalazinyl group, a quinoxalinyl group, a quinazolinyl group, a purinyl group, a pteridine group, an azepinyl group, and a benzooxepinyl group.

Examples of the substituents on $R^{11}$ include an alkyl group, an alkenyl group, an alkynyl group, an aryl group, a heterocyclic group, an alkoxy group, an aryloxy group, a heterocyclic oxy group, an alkylthio group, an arylthio group, a heterocyclic thio group, an acyloxy group, an acylthio group, an alkoxycarbonyloxy group, an aryloxycarbonyloxy group, a carbamoyloxy group, an alkylsulfonyloxy group, an arylsulfonyloxy group, an amino group, an alkylamino group, an arylamino group, an amide group, an alkoxycarbonylamino group, an aryloxycarbonylamino group, an ureide group, a sulfonamide group, a sulfamoylamino group, an acyl group, an alkoxycarbonyl group, an aryloxycarbonyl group, a carbamoyl group, an acylcarbamoyl group, a carbamoylcarbamoyl group, a sulfonylcarbamoyl group, a sulfamoylcarbamoyl group, an alkylsulfonyl group, an arylsulfonyl group, an alkylsulfinyl group, an arylsulfinyl group, an alkoxysulfonyl group, an aryloxysulfonyl group, a sulfamoyl group, an acylsulfamoyl group, a carbamoylsulfamoyl group, a halogen atom, a nitro group, a cyano group, a carboxy group, a sulfo group, a phosphono group, a hydroxyl group, a mercapto group, an imide group, and an azo group.

$R^{12}$ represents an alkyl, alkenyl, alkynyl, aryl or heterocyclic group which may optionally have substituents.

The alkyl group represented by $R^{12}$ preferably include a $C_{1-16}$ straight-chain, branched or cyclic alkyl group. Examples of such an alkyl group include a methyl group, an ethyl group, a hexyl group, a dodecyl group, a 2-octyl group, a t-butyl group, a cyclopentyl group, and a cyclooctyl group.

The alkenyl group represented by $R^{12}$ preferably include a $C_{2-16}$ straight-chain or cyclic alkenyl group. Examples of such an alkenyl group include a vinyl group, a 1-octenyl group, and a cyclohexenyl group.

The alkynyl group represented by $R^{12}$ preferably include a $C_{2-16}$ alkynyl group such as a 1-butynyl group and a phenylethynyl group. Examples of the aryl group and the heterocyclic group represented by $R^{12}$ include those described with reference to $R^{11}$. Examples of the substituents on $R^{12}$ include those described with reference to $R^{11}$.

Preferred among the groups represented by X are —$SO_2$—, —CO—, —COCO—, and —CO—N($R^{13}$)—, more preferably —$SO_2$—, —CO—N($R^{13}$)—, particularly —CO—N($R^{13}$)—, wherein $R^{13}$ represents a hydrogen atom or groups represented by $R^{12}$, preferably $R^{13}$ represents a hydrogen atom.

Specific examples of the compound represented by formula (I) will be given below.

I-1
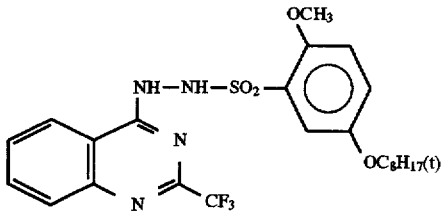
I-2
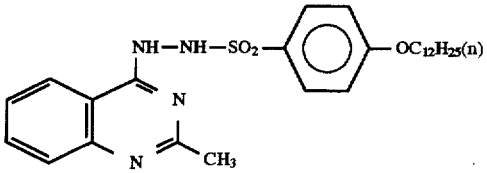
I-3
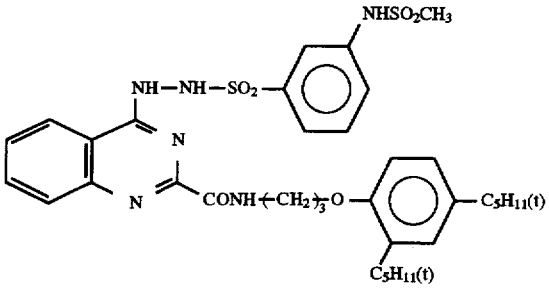
I-4
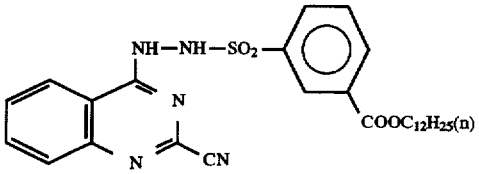
I-5
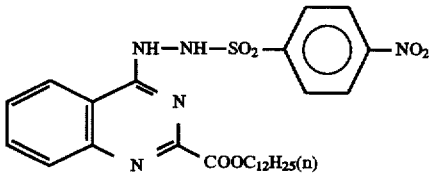
I-6
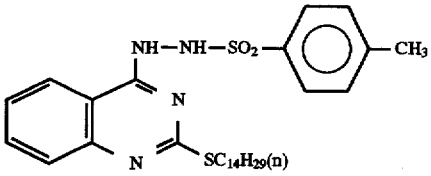
I-7
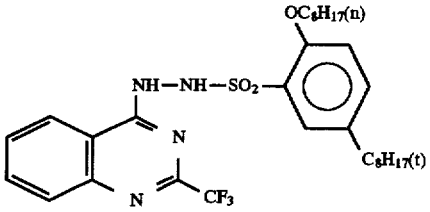
I-8
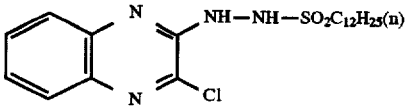

-continued
I-9
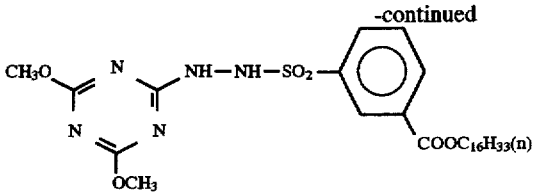
I-10
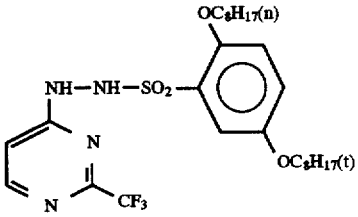
I-11
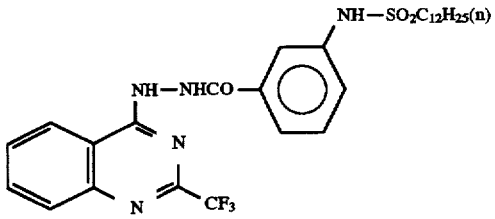
I-12
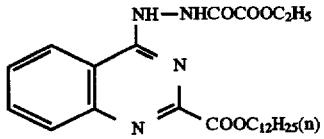
I-13
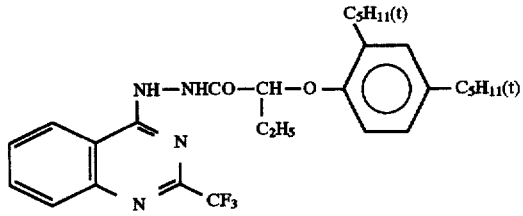
I-14
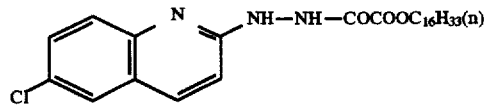
I-15
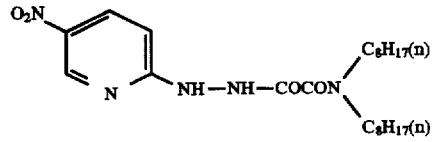
I-16
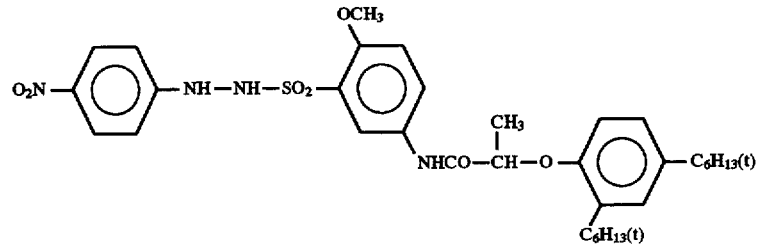
I-17
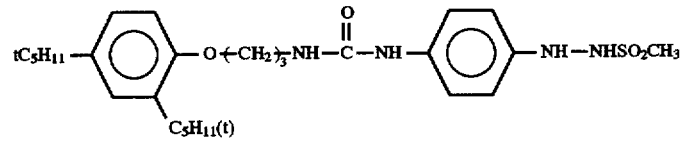

-continued
I-18
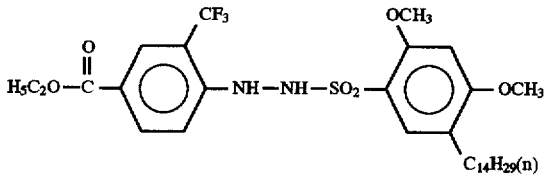
I-19
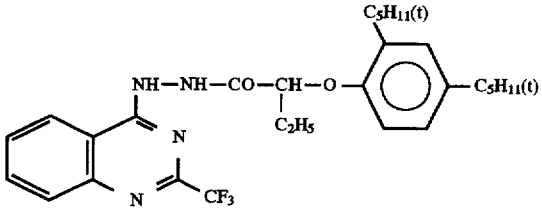
I-20
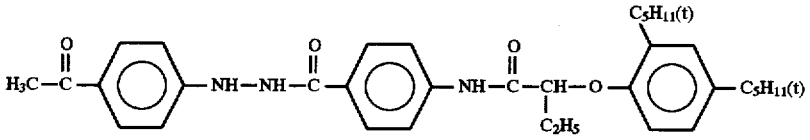
I-21
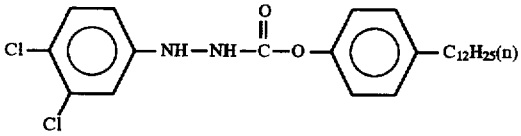
I-22
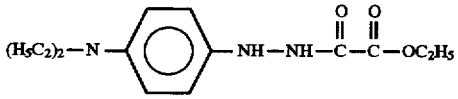
I-23
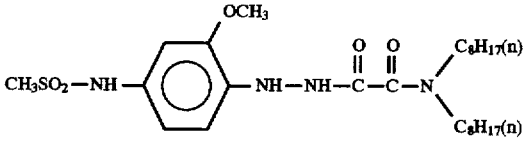
I-24
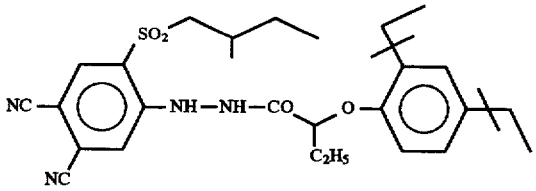
I-25
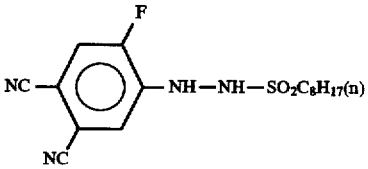
I-26
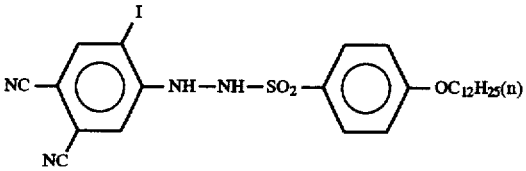

-continued
I-27
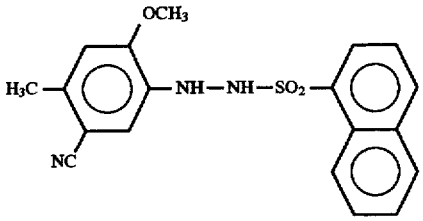
I-28
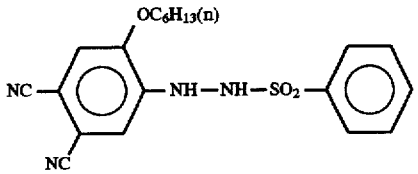
I-29
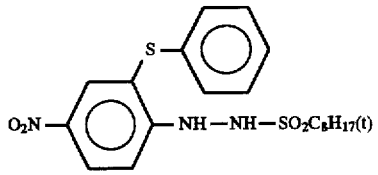
I-30
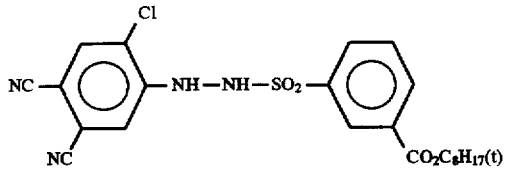
I-31
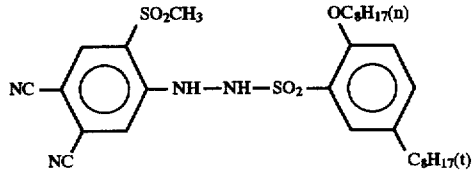
I-32
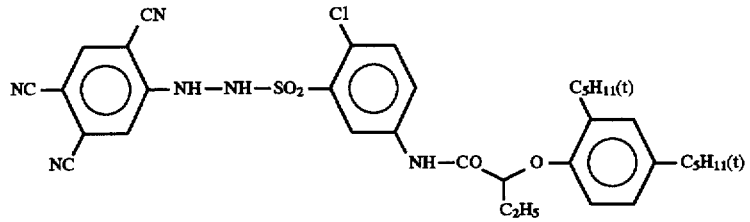
I-33
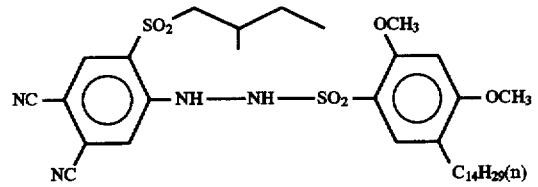
I-34
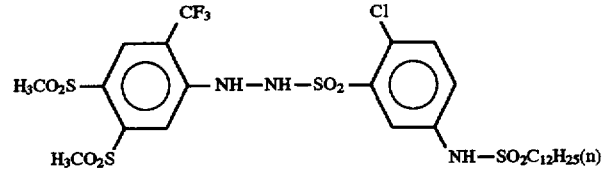

-continued
I-35
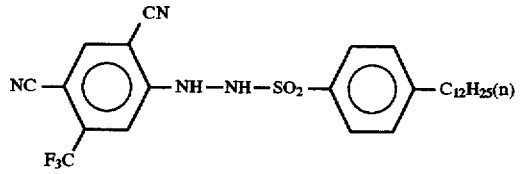
I-36
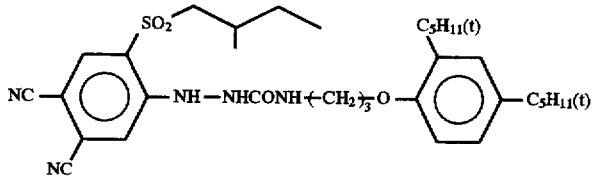
I-37
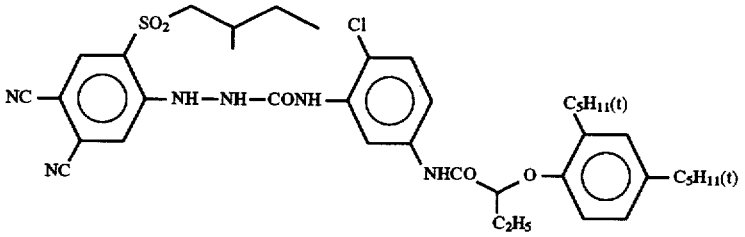
I-38
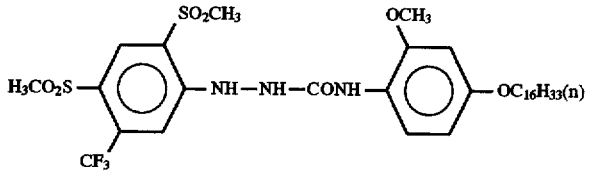
I-39
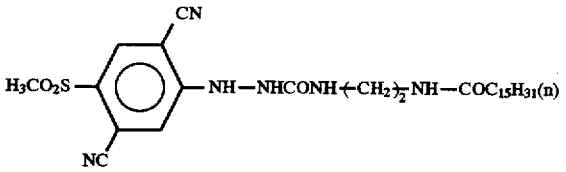
I-40
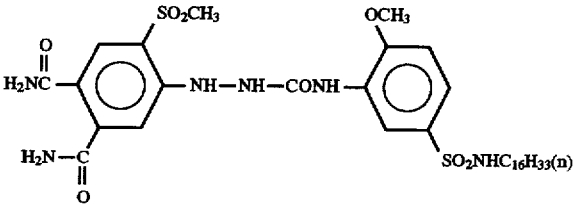
I-41
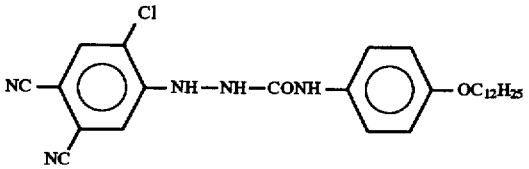
I-42
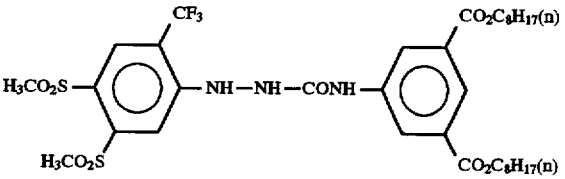

-continued
I-43
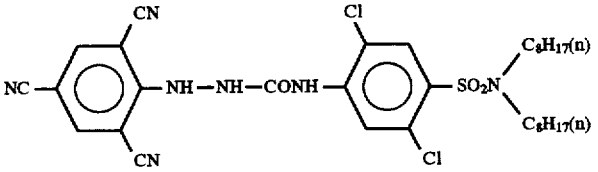
I-44
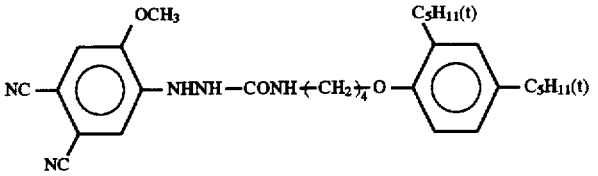
I-45
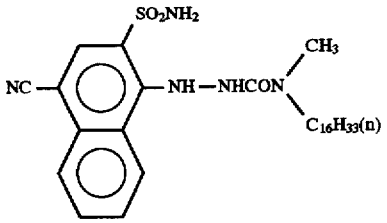
I-46
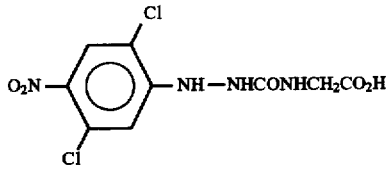
I-47
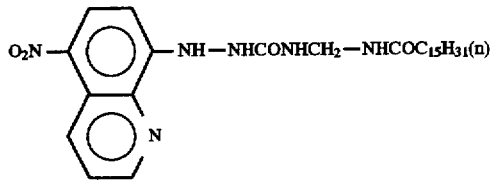
I-48
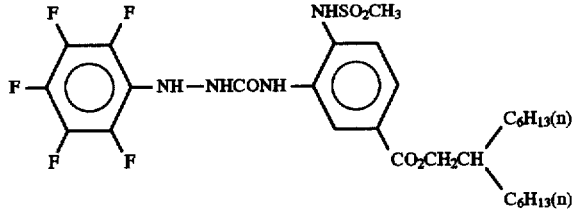
I-49
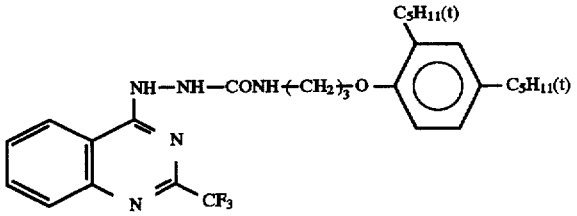
I-50
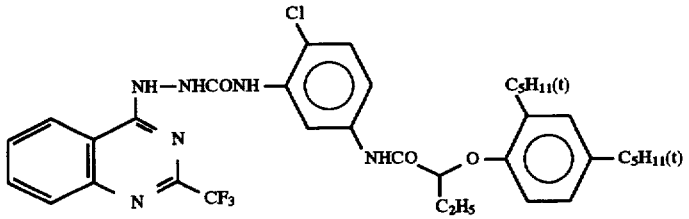

-continued
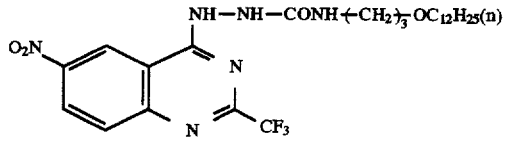
I-51
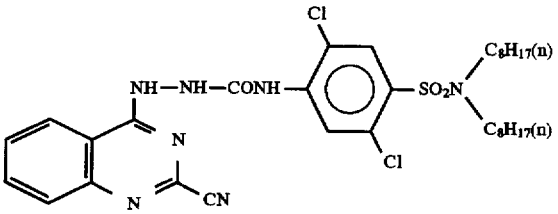
I-52
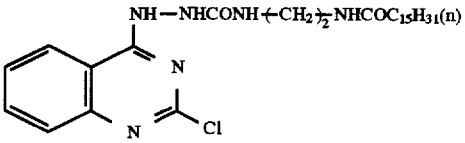
I-53
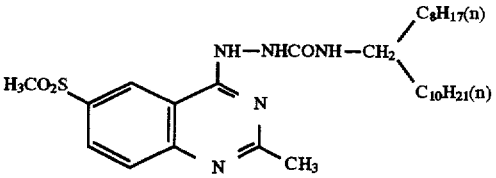
I-54
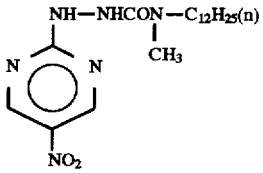
I-55
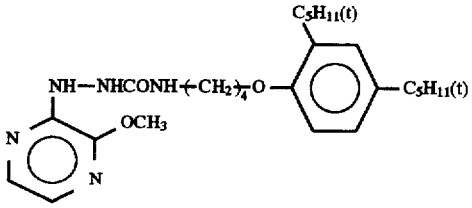
I-56
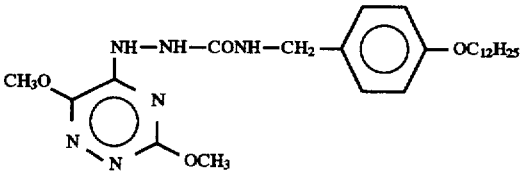
I-57
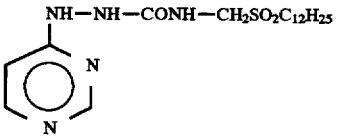
I-58
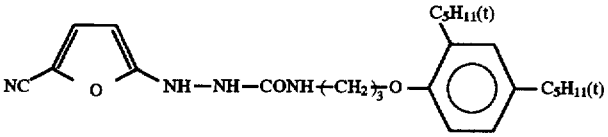
I-59

-continued

I-60

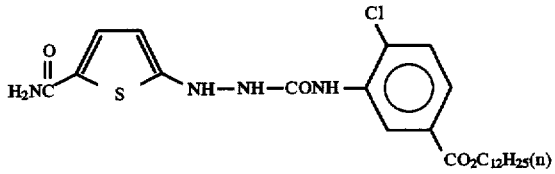

Some of compounds of the present invention represented by formula (I) are described in U.S. Pat. Nos. 2,424,256 and 4,481,268, EP0565165A1, and JP-A-61-259249. Other compounds of the present invention can be synthesized by methods described in these references.

These coloring reducing agents may be incorporated in the photographic light-sensitive material in the same manner as used for dye-forming coupler described later. The coloring reducing agent may be incorporated in layers adjacent to the light-sensitive layer but is preferably incorporated in the light-sensitive layer (silver halide emulsion layer) to provide a higher color development efficiency. Further, the various light-sensitive layers preferably comprise different coloring reducing agents to adjust the activity thereof. The content of the coloring reducing agent in each of these layers is preferably from $1\times10^{-5}$ mol to $1.0\times10^{-2}$ mol, more preferably from $1\times10^{-4}$ mol to $1\times10^{-3}$ mol per $m^2$.

The content of the dye-forming coupler described later is preferably from 0.05 to 10 mols, more preferably from 0.2 to 5 mols per mol of the coloring reducing agent used.

The auxiliary developing agent or precursor thereof which may be incorporated in the photographic light-sensitive material of the present invention will be further described hereinafter.

The auxiliary developing agent to be used in the present invention is a compound capable of developing exposed silver halide grains to produce an oxidation product which oxidizes a coloring reducing agent (hereinafter referred to as "cross oxidation").

As the auxiliary developing agent to be used in the present invention there may be preferably used a pyrazolidone compound, a dihydroxybenzene compound, a reductone compound or an aminophenol compound, particularly a pyrazolidone compound (hereinafter sometimes referred to as "pyrazolidones"). Such an auxiliary developing agent preferably has a low dispersibility in the hydrophilic colloidal layer. For example, the auxiliary developing agent preferably has a water solubility (25° C.) of not more than 0.1%, more preferably not more than 0.05%, particularly not more than 0.01%.

The precursor of the auxiliary developing agent to be used in the present invention is a compound which stably occurs in the photographic light-sensitive material but rapidly releases the foregoing auxiliary developing agent once processed with a processing solution. This compound also preferably has a low dispersibility in the hydrophilic colloidal layer. For example, this compound preferably has a water solubility (25° C.) of not more than 0.1%, more preferably not more than 0.05%, particularly not more than 0.01%. While the solubility of the auxiliary developing agent thus released from the precursor is not specifically limited, the auxiliary developing agent preferably has a low solubility itself.

The auxiliary developing agent precursor of the present invention is preferably represented by the following formula (A):

$$A—(L)_n—PUG \qquad (A)$$

The auxiliary developing agent is preferably represented by formula (B-1) or (B-2):

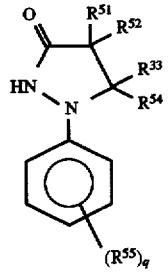

(B-1)

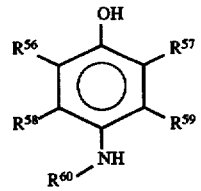

(B-2)

In formula (A), A represents a block group which undergoes cleavage of bond to $(L)_n$—PUG, L represents a connecting group which undergoes cleavage of bond to PUG after L—A bond cleavage, n represents an integer of from 0 to 3, and PUG represents an auxiliary developing agent.

The group represented by formula (A) will be further described hereinafter.

As the block group represented by A there may be any compound which is already known. Examples of such a compound include block groups such as an acyl group and a sulfonyl group as described in JP-B-48-9968, JP-A-52-8828, JP-A-57-82834, U.S. Pat. No. 3,311,476, and JP-B-47-44805 (U.S. Pat. No. 3,615,617), block groups utilizing reverse Michel reaction as described in JP-B-55-17369 (U.S. Pat. No. 3,888,677), JP-B-55-9696 (U.S. Pat. No. 3,791,830), JP-B-55-34927 (U.S. Pat. No. 4,009,029), JP-A-56-77842 (U.S. Pat. No. 4,307,175), JP-A-59-105640, JP-A-59-105641, and JP-A-59-105642, block groups which undergo intramolecular electron migration to produce quinone methide or analogous compound as described in JP-B-54-39727, U.S. Pat. Nos. 3,674,478, 3,932,480, and 3,993,661, JP-A-57-135944, JP-A-57-135945 (U.S. Pat. No. 4,420,554), JP-A-57-136640, JP-A-61-196239, JP-A-61-196240 (U.S. Pat. No. 4,702,999), JP-A-61-185743, JP-A-61-124941 (U.S. Pat. No. 4,639,408), and JP-A-2-280140, block groups utilizing intramolecular nucleophilic substitution reaction as described in U.S. Pat. Nos. 4,358,525 and 4,330,617, JP-A-55-53330 (U.S. Pat. No. 4,310,612), JP-A-59-121328, JP-A-59-218439, and JP-A-63-318555 (EP0295729), block groups utilizing opening of 5- or 6-membered ring as described in JP-A-57-76541 (U.S. Pat. No. 4,335,200), JP-A-57-135949 (U.S. Pat. No. 4,350,752), JP-A-57-179842, JP-A-59-137945, JP-A-59-140445, JP-A-59-219741, JP-A-59-202459, JP-A-60-41034 (U.S. Pat. No. 4,618,563), JP-A-62-59945 (U.S. Pat. No. 4,888,268), JP-A-

62-65039 (U.S. Pat. No. 4,772,537), JP-A-62-80647, JP-A-3-236047, and JP-A-3-238445, block groups utilizing the addition reaction of a nucleophilic agent to a conjugated unsaturated bond as described in JP-A-59-201057 (U.S. Pat. No. 4,518,685), JP-A-61-95346 (U.S. Pat. No. 4,690,885), JP-A-61-95347 (U.S. Pat. No. 4,892,811), JP-A-64-7035, JP-A-64-42650 (U.S. Pat. No. 5,066,573), JP-A-1-245255, JP-A-2-207249, JP-A-2-235055 (U.S. Pat. No. 5,118,596) and JP-A-4-186344, block groups utilizing β-elimination reaction as described in JP-A-59-93442, JP-A-61-32839, JP-A-62-163051, and JP-B-5-37299, block groups utilizing nucleophilic substitution reaction of diarylmethane as described in JP-A-61-188540, block groups utilizing Lossen rearrangement reaction as described in JP-A-62-187850, block groups utilizing the reaction of N-acylation product of thiazolidine-2-thione with amine as described in JP-A-62-80646, JP-A-62-144163, and JP-A-62-147457, block groups which undergo reaction with a binucleophilic agent having two electrophilic groups as described in JP-A-2-296240 (U.S. Pat. No. 5,019,492), JP-A-4-177243, JP-A-4-177244, JP-A-4-177245, JP-A-4-177246, JP-A-4-177247, JP-A-4-177248, JP-A-4-177249, JP-A-4-179948, JP-A-4-184337, JP-A-4-184338, International Patent Publication No. WO92/21064, JP-A-4-330438, International Patent Publication No. WO93/03419, and JP-A-5-45816, and block groups as described in JP-A-3-236047 and JP-A-3-238445.

In the compound represented by formula (A), the group represented by L may be any connecting group which can undergo cleavage of bond to PUG after separation from the group represented by A during processing. Examples of such a connecting group include groups utilizing cleavage of hemiacetyltal ring as described in U.S. Pat. Nos. 4,146,396, 4,652,516, and 4,698,297, timing groups which cause intramolecular nucleophilic substitution reaction as described in U.S. Pat. Nos. 4,248,962, 4,847,185, and 4,857,440, timing groups which cause cleavage reaction utilizing electron migration reaction as described in U.S. Pat. Nos. 4,409,323 and 4,421,845, groups which cause cleavage reaction utilizing hydrolysis reaction of iminoketal as described in U.S. Pat. No. 4,546,073, groups which cause cleavage reaction utilizing hydrolysis reaction of ester as described in West German Patent 2,626,317, and groups which cause cleavage reaction utilizing reaction with sulfurous ion as described in EP0572084. L is bonded to A at a hetero atom contained therein, preferably oxygen atom, sulfur atom or nitrogen atom.

PUG in formula (A) will be further described hereinafter.

PUG in formula (A) represents an auxiliary developing agent. The term "auxiliary developing agent" as used herein is meant to indicate a substance which acts to accelerate the migration of electron from a color developing agent to silver halide in the process of development of silver halide. The auxiliary developing agent of the present invention is an electron-releasing compound following Kendall-Perutz's Law, preferably represented by formula (B-1) or (B-2) described above. Particularly preferred among these compounds is one represented by formula (B-1).

In formulae (B-1) and (B-2), $R^{51}$ to $R^{54}$ each represent a hydrogen atom, an alkyl group, a cycloalkyl group, an alkenyl group, an aryl group or a heterocyclic group.

$R^{55}$ to $R^{59}$ each represent a hydrogen atom, a cyano group, an alkyl group, a cycloalkyl group, an alkenyl group, an aryl group, a heterocyclic group, an alkoxy group, a cycloalkyloxy group, an aryloxy group, a heterocyclic oxy group, a silyloxy group, an acyloxy group, an amino group, an anilino group, a heterocyclic amino group, an alkylthio group, an arylthio group, a heterocyclic thio group, a silyl group, a hydroxyl group, a nitro group, an alkoxycarbonyloxy group, a cycloalkyloxycarbonyloxy group, an aryloxycarbonyloxy group, a carbamoyloxy group, a sulfamoyloxy group, an alkanesulfonyloxy group, an allenesulfonyloxy group, an acyl group, an alkoxycarbonyl group, a cycloalkyloxycarbonyl group, an aryloxycarbonyl group, a carbamoyl group, a carbonamide group, an ureide group, an imide group, an alkoxycarbonylamino group, an aryloxycarbonylamino group, a sulfonamide group, a sulfamoylamino group, an alkylsulfinyl group, an allenesulfinyl group, an alkanesulfonyl group, an allenesulfonyl group, a sulfamoyl group, a sulfo group, a phosphinoyl group or a phosphinoylamino group.

The suffix q represents an integer of from 0 to 5. When q is 2 or more, the plurality of groups represented by $R^{55}$ may be the same or different. $R^{60}$ represents an alkyl or aryl group.

The auxiliary developing agent represented by formula (B-1) or (B-2) may correspond to PUG in formula (A). The auxiliary developing agent is connected to the other moiety of the coloring reducing agent at its oxygen atom or nitrogen atom.

Specific examples of the compound represented by formula (A), (B-1) or (B-2) will be given below, but the auxiliary developing agent or its precursor to be used in the present invention should not be construed as being limited thereto.

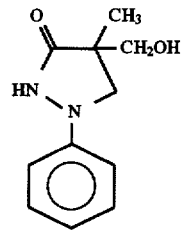

(ETA-1)

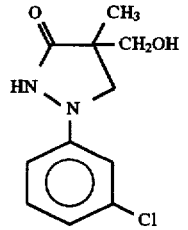

(ETA-2)

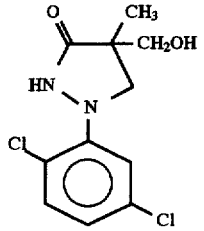

(ETA-3)

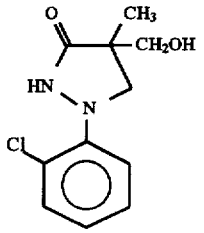

(ETA-4)

-continued
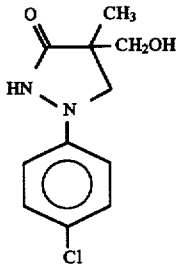
(ETA-5)
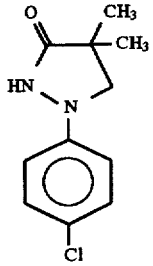
(ETA-6)
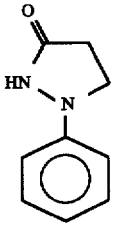
(ETA-7)
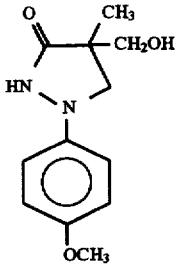
(ETA-8)
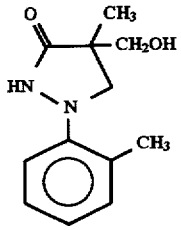
(ETA-9)
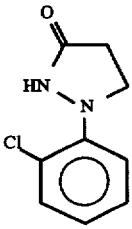
(ETA-10)
-continued
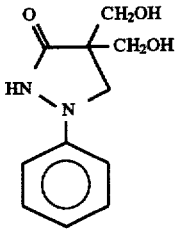
(ETA-11)
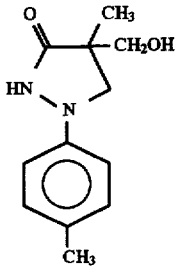
(ETA-12)
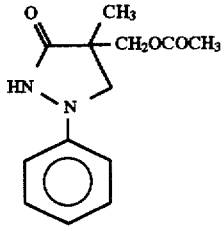
(ETA-13)
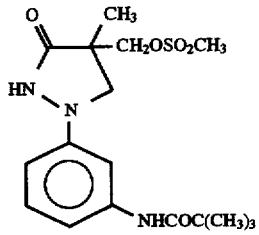
(ETA-14)
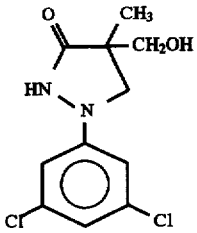
(ETA-15)
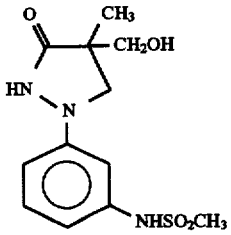
(ETA-16)

-continued
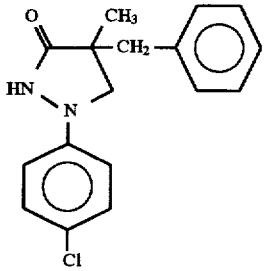
(ETA-17)
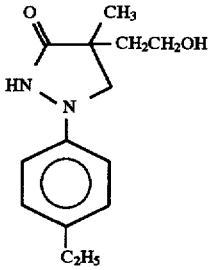
(ETA-18)
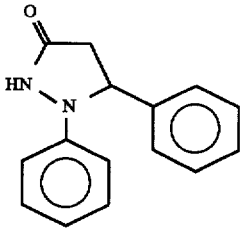
(ETA-19)
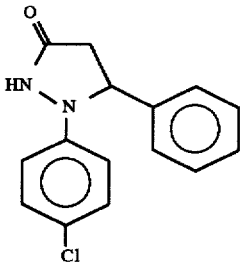
(ETA-20)
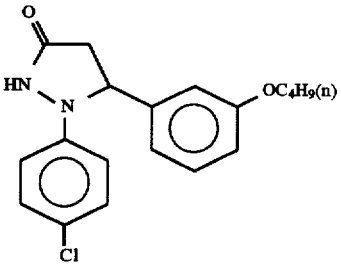
(ETA-21)
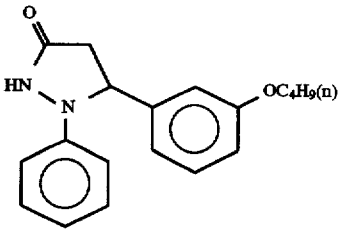
(ETA-22)
-continued
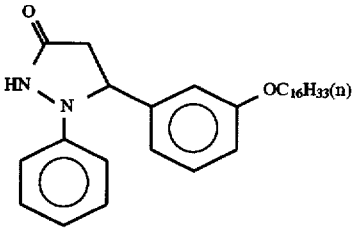
(ETA-23)
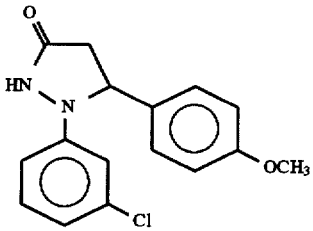
(ETA-24)
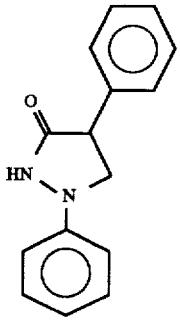
(ETA-25)
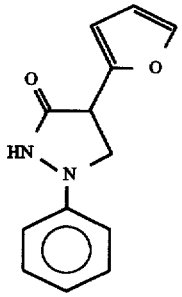
(ETA-26)
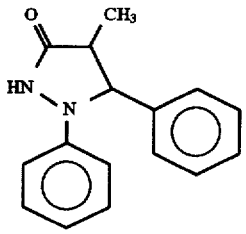
(ETA-27)
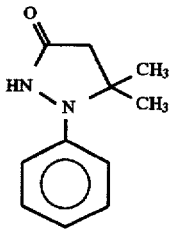
(ETA-28)

-continued
(ETA-29)
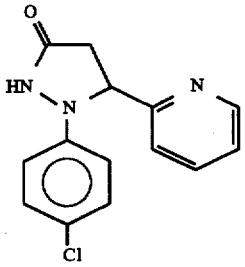
(ETA-30)
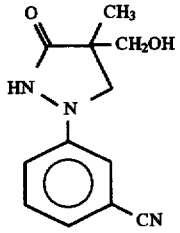
(ETA-31)
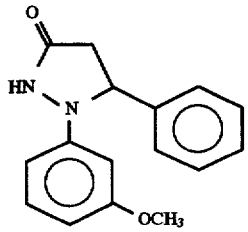
(ETA-32)
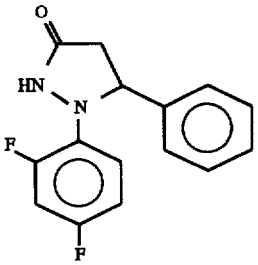
(ETA-33)
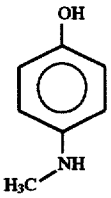
(ETA-34)
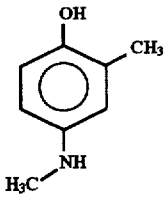
(ETA-35)
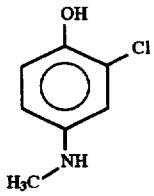
-continued
(ETA-36)
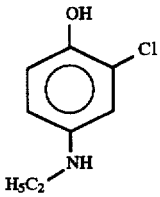
(ETA-37)
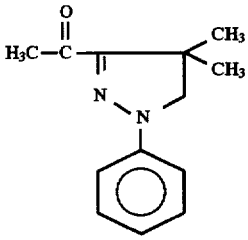
(ETA-38)
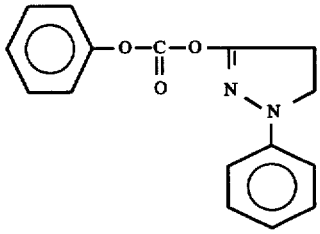
(ETA-39)
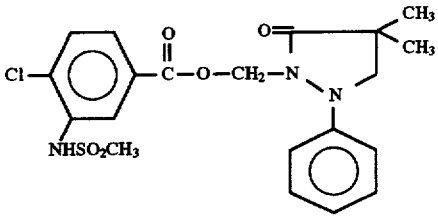
(ETA-40)
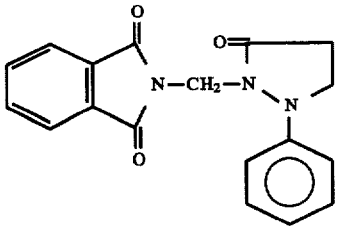
(ETA-41)
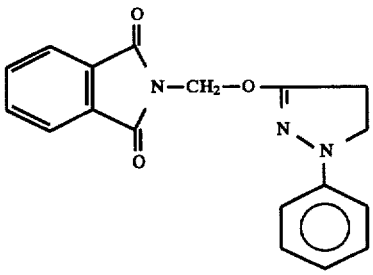

-continued

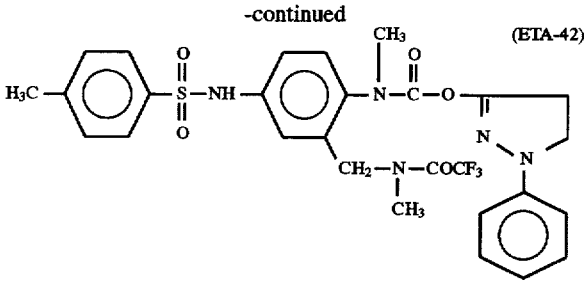

(ETA-42)

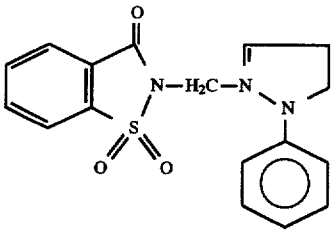

(ETA-43)

Such a compound may be incorporated in any of a light-sensitive layer, an interlayer, an undercoating layer and a protective layer. If the silver halide color light-sensitive material comprises an auxiliary developing agent incorporated therein, such a compound is preferably incorporated in a light-insensitive layer.

Examples of the method for incorporating the auxiliary developing agent in the photographic light-sensitive material include a method which comprises directly incorporating such a compound in the hydrophilic colloidal layer in the form of solution in a water-miscible organic solvent such as methanol, a method which comprises incorporating such a compound in the form of aqueous solution or colloidal dispersion in the presence of a surface active agent, and a method which comprises dissolving such a compound in a substantially water-immiscible solvent or an oil, and then incorporating the solution in the photographic light-sensitive material in the form of dispersion in water or hydrophilic colloid or fine solid dispersion. These known methods may be used singly or in combination.

The amount of the auxiliary developing agent to be incorporated in the photographic light-sensitive material is from 1 to 200 mol %, preferably from 5 to 100 mol %, more preferably from 10 to 50 mol %, based on the amount of the coloring reducing agent contained.

As the dye-forming coupler of the present invention there may be used a compound which reacts with an oxidation of a coloring reducing agent to produce a dye. This coupler may be two-equivalent or four-equivalent. It may be properly selected depending on the kind of the coloring reducing agent used.

In the case where a sulfonylhydrazine compound is used as a coloring reducing agent, for example, the amino group which is a coupling position is protected by sulfonyl. If there is a substituent on the coupling position of the coupler, the resulting steric hindrance hinders coupling reaction. Thus, a four-equivalent coupler is preferred in this case. If a carbamoylhydrazine (semicarbazide) compound is used, it is particularly preferred that a two-equivalent coupler be used to enhance the coupling activity. Specific examples of two-equivalent and four-equivalent couplers are further described in T. H. James, *Theory of the Photographic Process*, 4th. Ed., Macmillan, 1977, pp. 291–334 and pp. 354–361, JP-A-58-12353, JP-A-58-149046, JP-A-58-149047, JP-A-59-11114, JP-A-59-124399, JP-A-59-174835, JP-A-59-231539, JP-A-59-231540, JP-A-60-2951, JP-A-60-14242, JP-A-60-23474, and JP-A-60-66249.

Examples of couplers which may be preferably used in the present invention will be given below.

Examples of the coupler which may be preferably used in the present invention include compounds having structures represented by the following formulae (1) to (12). These compounds are generically known as active methylenes, pyrazolones, Pyrazoloazoles, phenols, naphthols and pyrrolotriazoles in the art.

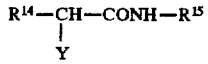

(1)

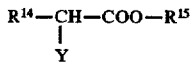

(2)

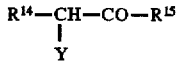

(3)

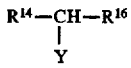

(4)

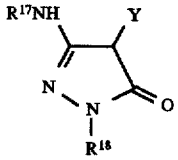

(5)

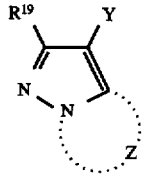

(6)

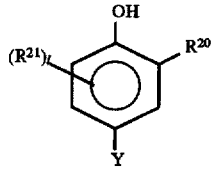

(7)

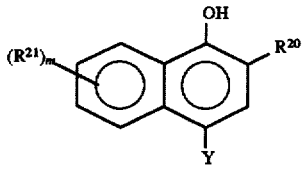

(8)

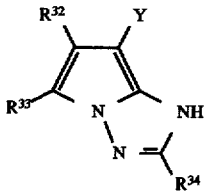

(9)

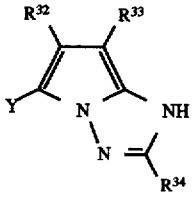

(10)

-continued (11)

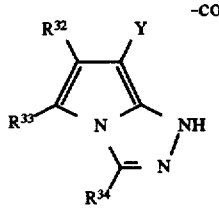

(12)

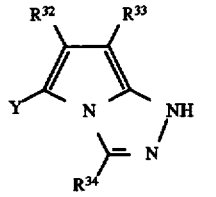

Formulae (1) to (4) each represent a coupler called an active methylene coupler. In these formulae, $R_{14}$ is an acyl group, a cyano group, a nitro group, an aryl group, a heterocyclic group, an alkoxycarbonyl group, an aryloxycarbonyl group, a carbamoyl group, a sulfamoyl group, an alkylsulfonyl group or an arylsulfonyl group which may optionally contain substituents.

In formulae (1) to (3), $R_{15}$ is an alkyl group, an aryl group or a heterocyclic group which may optionally contain substituents. In formula (4), $R_{16}$ is an aryl group or a heterocyclic group which may optionally contain substituents. Examples of substituents which $R_{14}$, $R_{15}$ and $R_{16}$ may contain include various substituents such as an alkenyl group, an alkynyl group, an aryl group, a heterocyclic group, an alkoxy group, an aryloxy group, a cyano group, a halogen atom, an acylamino group, a sulfonamide group, a carbamoyl group, a sulfamoyl group, an alkoxycarbonyl group, an aryloxycarbonyl group, an alkylamino group, an arylamino group, a hydroxyl group and a sulfo group. Preferred examples of $R_{14}$ include an acyl group, a cyano group, a carbamoyl group, and an alkoxycarbonyl group.

In formulae (1) to (4), Y is a hydrogen atom or a group which can be separated from the other moiety of the coupler upon coupling reaction with an oxidation product of a developing agent. Examples of Y include a carboxyl group, a formyl group, a halogen atom (e.g., bromine, iodine), a carbamoyl group, a substituted methylene group (examples of substituents include an aryl group, a sulfamoyl group, a carbamoyl group, an alkoxy group, an amino group, and a hydroxyl group), an acyl group, and a sulfo group. Preferred among these groups is a hydrogen atom as mentioned above.

In formulae (1) to (4), $R_{14}$ and $R_{15}$, and $R_{14}$ and $R_{16}$ may be connected to each other to form a ring.

Formula (5) represents a coupler called a 5-pyrazolone magenta coupler. In formula (5), $R_{17}$ represents an alkyl group, an aryl group, an acyl group or a carbamoyl group. $R_{18}$ represents a phenyl group which may be optionally substituted by one or more halogen atoms, alkyl groups, cyano groups, alkoxy groups, alkoxycarbonyl groups or acylamino groups. Y is as defined in formulae (1) to (4).

In a preferred embodiment of the 5-pyrazolone magenta coupler represented by formula (5), $R_{17}$ is an aryl or acyl group, $R_{18}$ is a phenyl group substituted by one or more halogen atoms, and Y is a hydrogen atom.

Referring further to such a preferred group, $R_{17}$ is an aryl group such as phenyl, 2-chlorophenyl, 2-methoxyphenyl, 2-chloro-5-tetradecaneamidephenyl, 2-chloro-5-(3-octadecenyl-1-succinimide)phenyl, 2-chloro-5-octadecyl sulfoneamidephenyl and 2-chloro-5-[2-(4-hydroxy-3-t-butylphenoxy)tetradecaneamide]phenyl or an acyl group such as acetyl, pivaloyl, tetradecanoyl, 2-(2,4-di-t-pentylphenoxy) butanoyl, benzoyl and 3-(2,4-diamylphenoxyacetazide)benzoyl. These groups may be further substituted, e.g., by organic substituents connected by carbon atom, oxygen atom, nitrogen atom or sulfur atom or halogen atoms.

$R_{18}$ is preferably a substituted phenyl group such as a 2,4,6-trichlorophenyl group, a 2,5-dichlorophenyl group and a 2-chlorophenyl group.

Formula (6) represents a coupler called pyrazoloazole coupler. In formula (6), $R_{19}$ represents a hydrogen atom or a substituent. Z represents a non-metallic atom group required to form a 5-membered azole ring containing from 2 to 4 nitrogen atoms. The azole ring may have substituents (including condensed ring). Y is as defined in formulae (1) to (4).

Among the pyrazoloazole couplers represented by formula (6), imidazo[1,2-b]pyrazoles as described in U.S. Pat. No. 4,500,630, pyrazolo[1,5-b][1,2,4]triazoles as described in U.S. Pat. No. 450,654, and pyrazolo[5,1-c][1,2,4]triazoles as described in U.S. Pat. No. 3,725,067 are preferred from the standpoint of absorption characteristics of developed dye. Preferred among these compounds is pyrazolo[1,5-b][1,2,4]triazole from the standpoint of light-fastness.

The substituent $R_{19}$, Y and substituents on the azole ring represented by Z are further described in U.S. Pat. No. 4,540,654, line 41 on 2nd column to line 27 on 8th column. Preferred examples of the pyrazoloazole coupler include pyrazoloazole coupler having branched alkyl group directly connected to the 2-, 3- or 6-position of pyrazolotriazole group as described in JP-A-61-65245, pyrazolo coupler containing sulfonamide group in its molecule as described in JP-A-61-65245, pyrazoloazole coupler having alkoxyphenylsulfonemaiude ballast group as described in JP-A-61-147254, pyrazolotriazole coupler having alkoxy group or aryloxy group in 6-position as described in JP-A-62-209457 and JP-A-63-307453, and pyrazolotriazole coupler having carbonamide group in its molecule as described in JP-A-2-201443.

Formulae (7) and (8) are couplers called a phenolic coupler and a naphtholic coupler, respectively. In these formulae, $R_{20}$ represents a hydrogen atom or a group selected from the group consisting of $—SO_2NR_{22}R_{23}$, $—NHSO_2R_{22}$, $—NHCOR_{22}$, $—NHCONR_{22}R_{23}$ and $—NHSO_2NR_{22}R_{23}$. $R_{22}$ and $R_{23}$ each represent a hydrogen atom or a substituent. In formulae (7) and (8), $R_{21}$ represents a substituent, l represents an integer of from 0 to 2, and m represents an integer of from 0 to 4. Y is as defined in formulae (1) to (4). Examples of $R_{21}$ to $R_{23}$ include substituents described with reference to $R_{14}$ to $R_{16}$.

Preferred examples of the phenolic coupler represented by formula (7) include 2-alkylamino-5-alkylphenol coupler as described in U.S. Pat. Nos. 2,369,929, 2,801,171, 2,895,826, and 3,772,002, 2,5-diacylaminophenol coupler as described in U.S. Pat. Nos. 2,772,162, 3,758,308, 4,126,396, 4,334,011, and 4,327,173, West German Patent 3,329,729, and JP-A-59-166956, and 2-phenylureide-5-acylaminophenol coupler as described in U.S. Pat. Nos. 3,446,622, 4,333,999, 4,451,559, and 4,427,767.

Preferred examples of the naphtholic coupler represented by formula (8) include 2-carbamoyl-1-naphthol coupler as described in U.S. Pat. Nos. 2,474,293, 4,052,212, 4,146,396, 4,228,233, and 4,296,200, and 2-carbamoyl-5-amide-1-naphthol coupler as described in U.S. Pat. No. 4,690,889.

Formulae (9) to (12) each represent a coupler called pyrrolotriazole. $R_{32}$, $R_{33}$ and $R_{34}$ each represent a hydrogen atom or a substituent. Y is as-defined in formulae (1) to (4). Examples of the substituent represented by $R_{32}$, $R_{33}$ or $R_{34}$ include those described with reference to $R_{14}$ to $R_{16}$. Preferred examples of the pyrrolotriazole coupler represented by formulae (9) to (12) include couplers wherein at least one of $R_{32}$ and $R_{33}$ is an electrophilic group as described in EP488248A1, EP491197A1, and EP545300.

Besides these couplers, couplers having structures such as condensed phenol, imidazole, pyrrole, 3-hydroxypyridine, active methylene, methine, 5,5-condensed heterocycle and 5,6-condensed heterocycle may be used.

As the condensed phenolic coupler there may be used a coupler as described in U.S. Pat. Nos. 4,327,173, 4,564,586, and 4,904,575.

As the imidazole coupler there may be used a coupler as described in U.S. Pat. Nos. 4,818,672 and 5,051,347.

As the pyrrolic coupler there may be used a coupler as described in JP-A-4-188137 and JP-A-4-190347.

As the 3-hydroxypyridine coupler there may be used a coupler as described in JP-A-1-315736.

As the active methylene coupler and methine coupler there may be used couplers as described in U.S. Pat. Nos. 5,104,783 and 5,162,196.

As the 5,5-condensed heterocyclic coupler there may be used pyrrolopyrazole coupler as described in U.S. Pat. No. 5,164,289, pyrroloimidazole coupler as described in JP-A-4-174429 or the like.

As the 5,6-condensed heterocyclic coupler there may be used pyrazolopyrimidine coupler as described in U.S. Pat. No. 4,950,585, pyrrolotriazine coupler as described in JP-A-4-204730, coupler as described in EP556700 or the like.

Beside the foregoing couplers, couplers as described in West German Patents 3,819,051A and 3,823,049, U.S. Pat. Nos. 4,840,883, 5,024,930, 5,051,347, and 4,481,268, EP304856A2, EP329,036, EP354549A2, EP374781A2, EP379110A2, EP386930A1, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731, and JP-A-4-204732 may be used.

Specific examples of the coupler which can be used in the present invention will be given below, but the present invention should not be of course construed as being limited thereto.

C-1

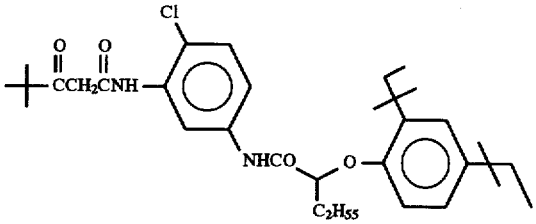

C-2

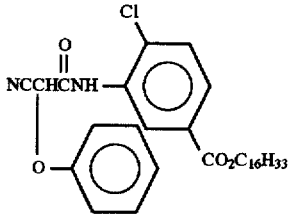

C-3

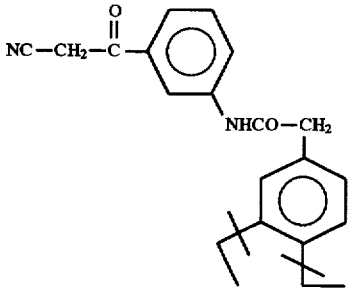

C-4

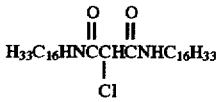

C-5

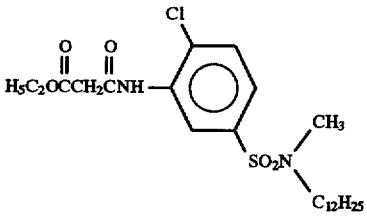

C-6

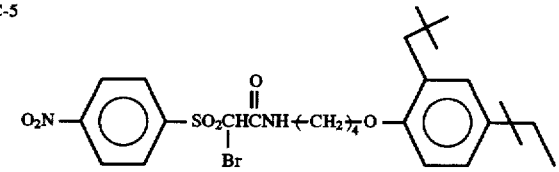

C-7

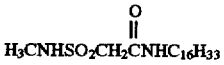

C-8

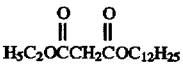

C-9

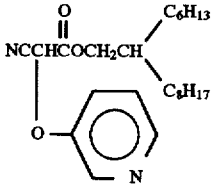

C-10

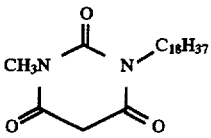

-continued
C-11
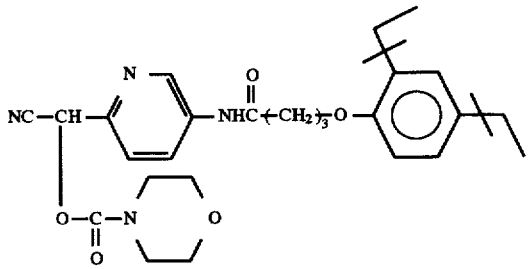
C-12
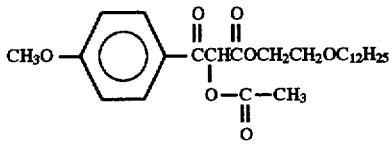
C-13
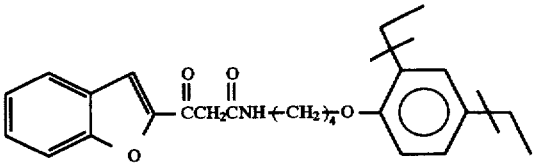
C-14
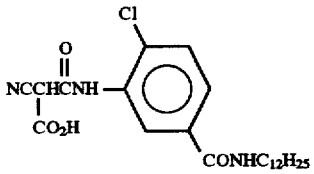
C-15
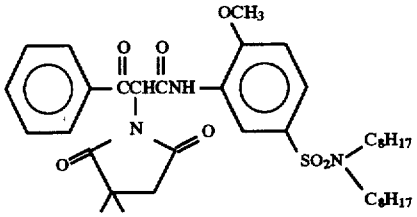
C-16
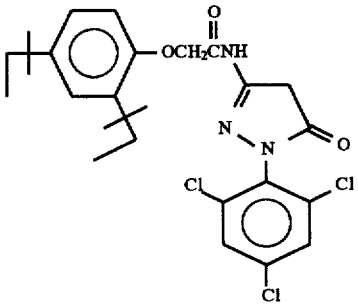
C-17
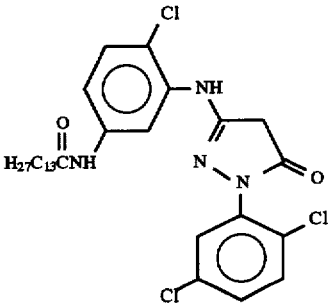
C-18
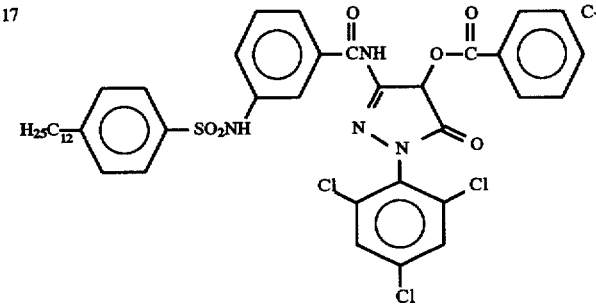
C-19
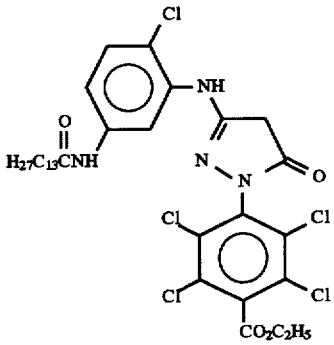
C-20
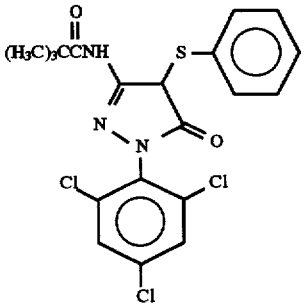

-continued
C-21
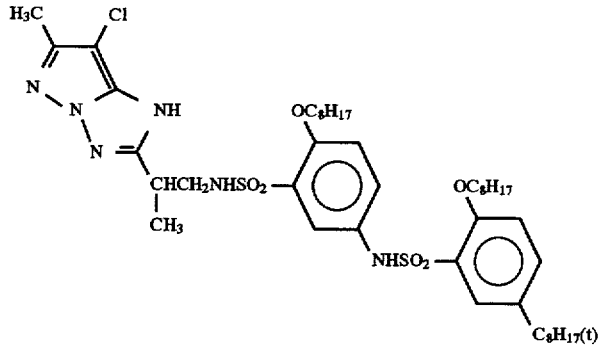
C-22
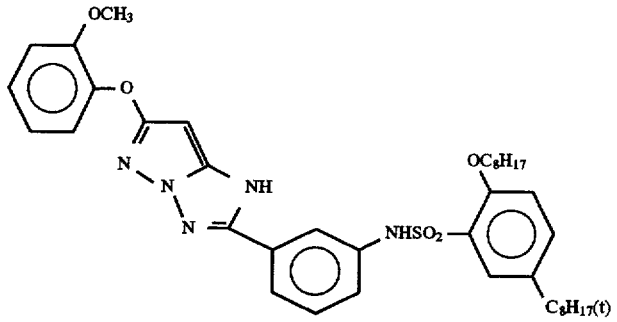
C-23
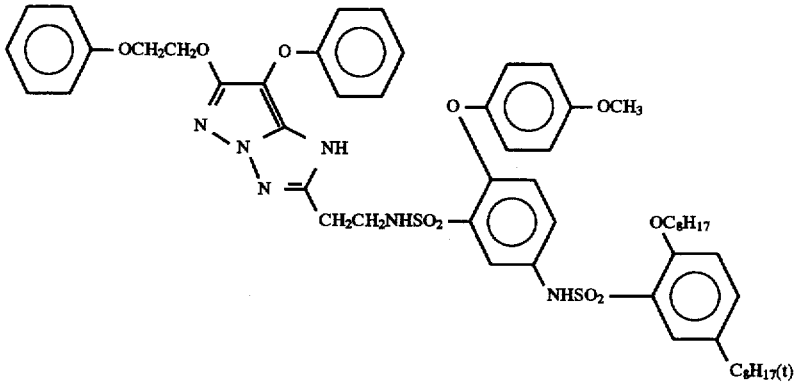
C-24
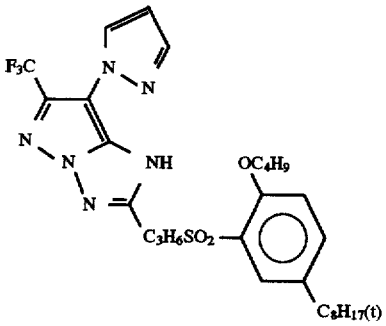
C-25
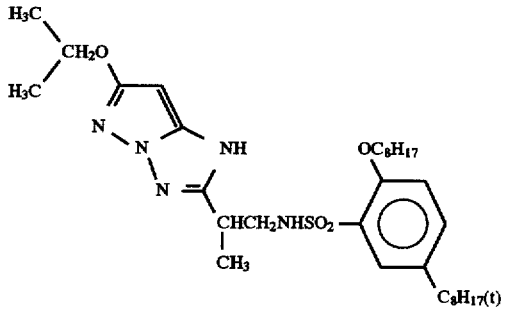
C-26
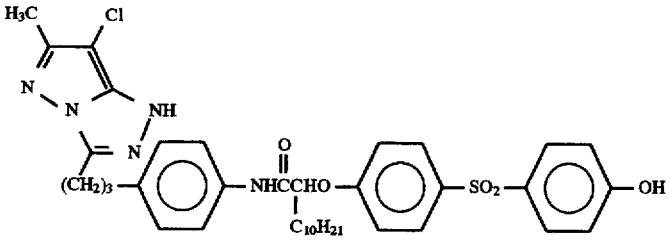

-continued
C-27
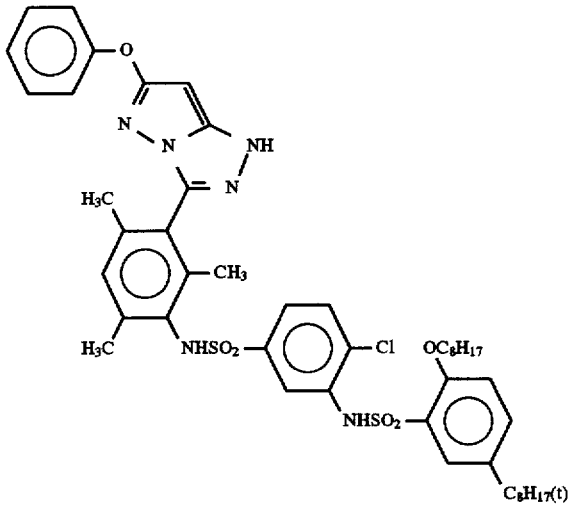
C-28
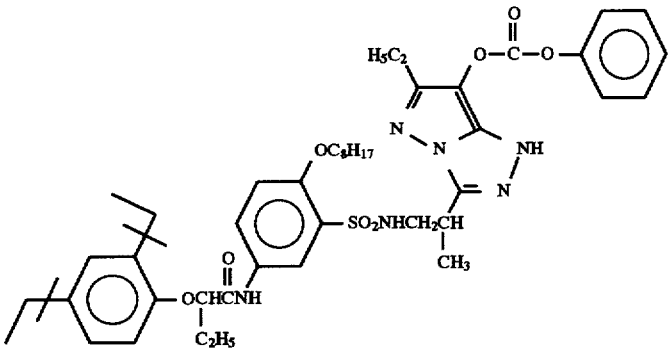
C-29
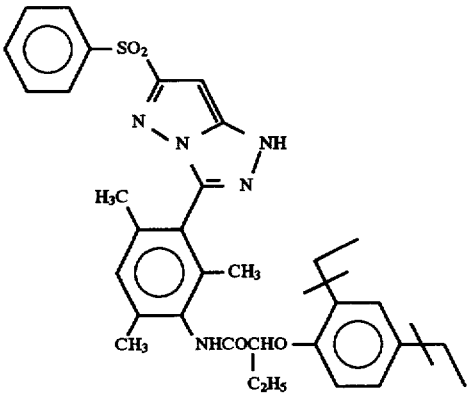
C-30
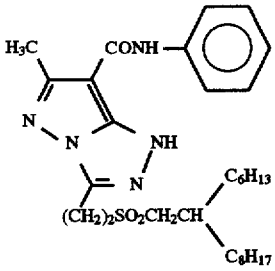
C-31
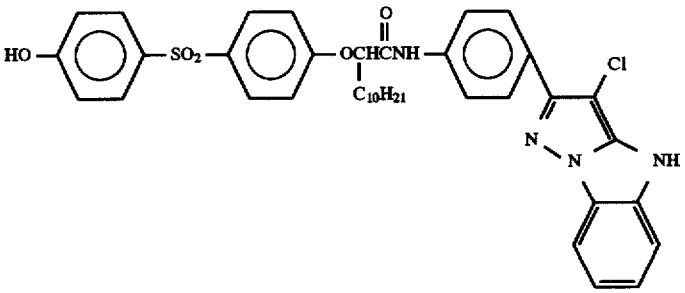

-continued
C-32
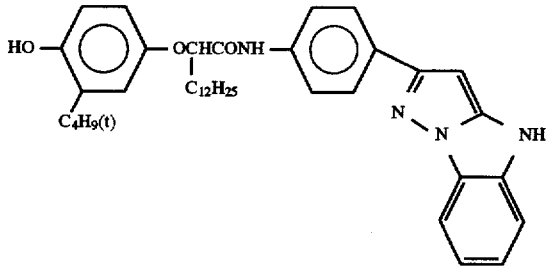
C-33
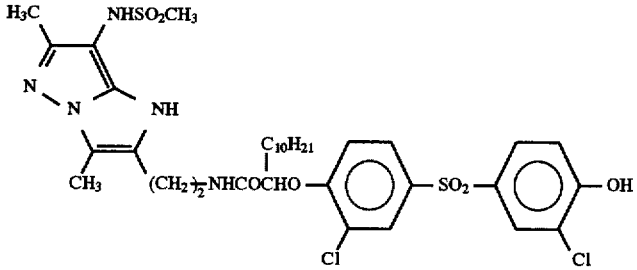
C-34
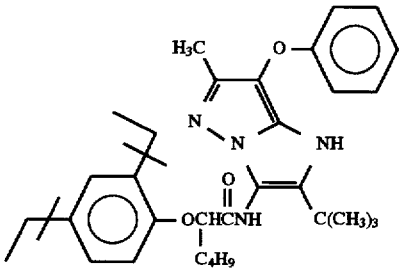
C-35
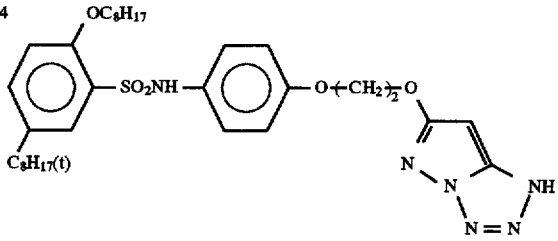
C-36
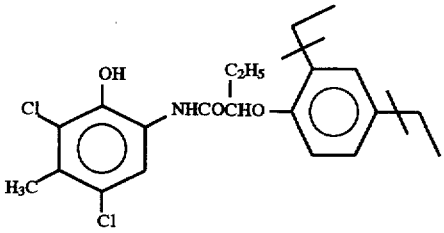
C-37
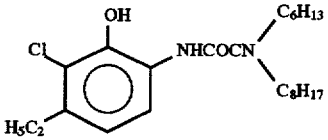
C-38
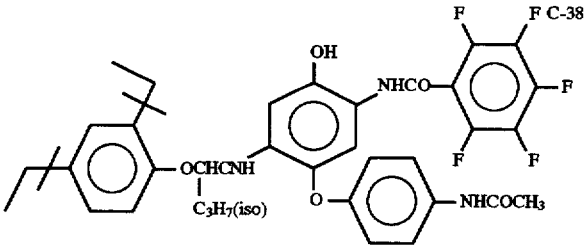
C-39
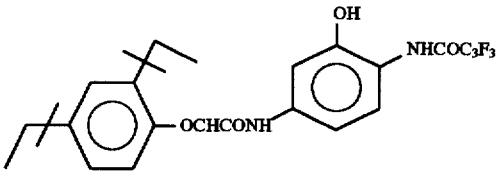
C-40
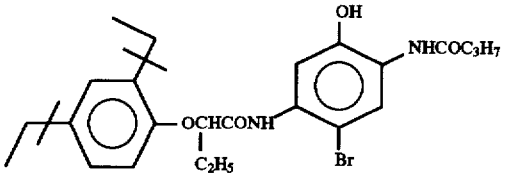
C-41
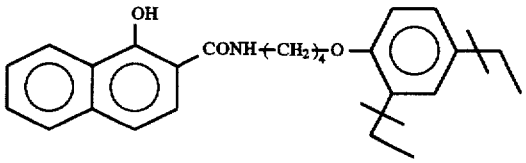

-continued
C-42
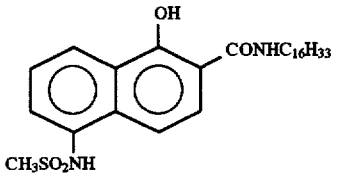
C-43
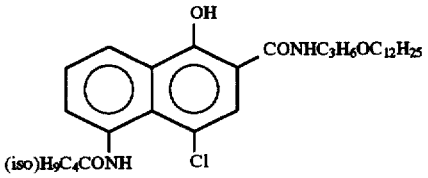
C-44
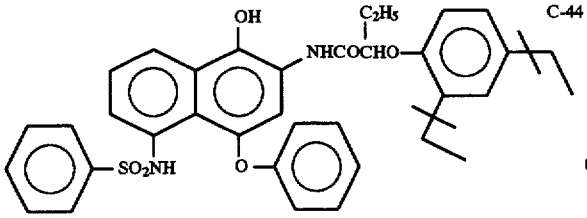
C-45
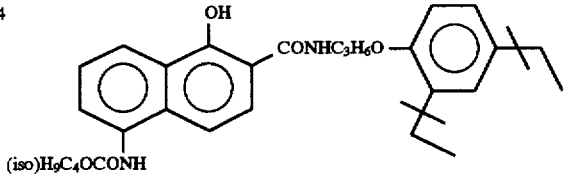
C-46
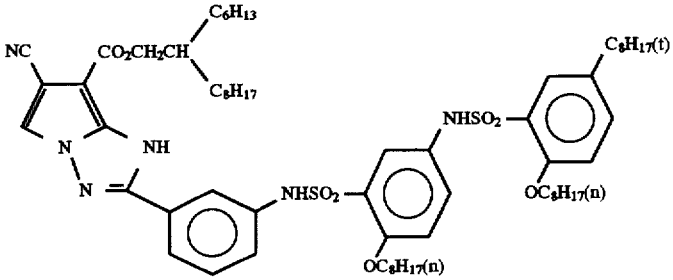
C-47
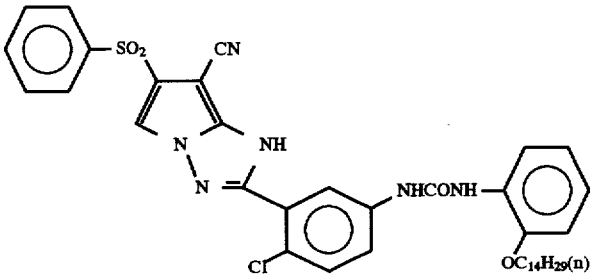
C-48
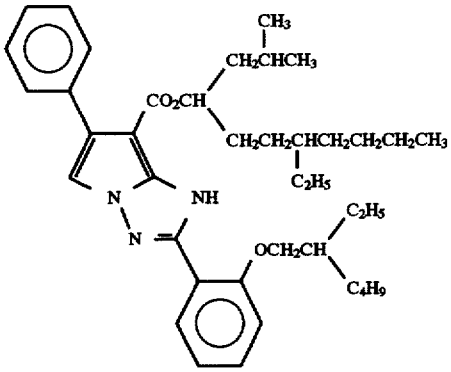
C-49
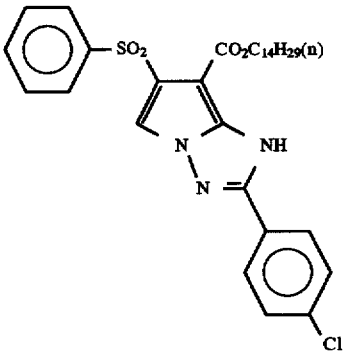
C-50
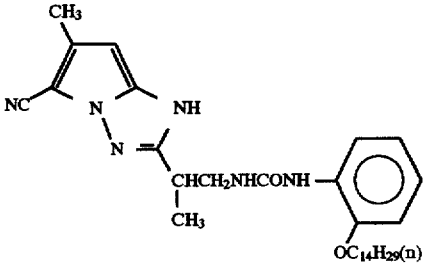
C-51
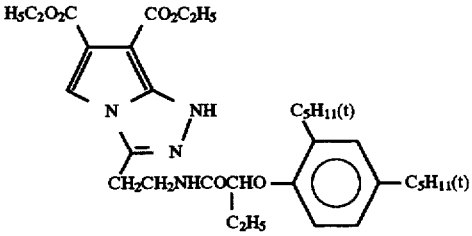

-continued
C-52
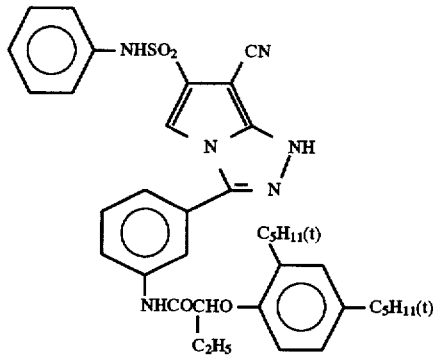
C-53
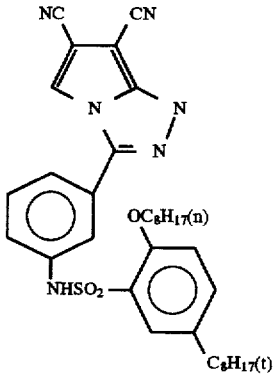
C-54
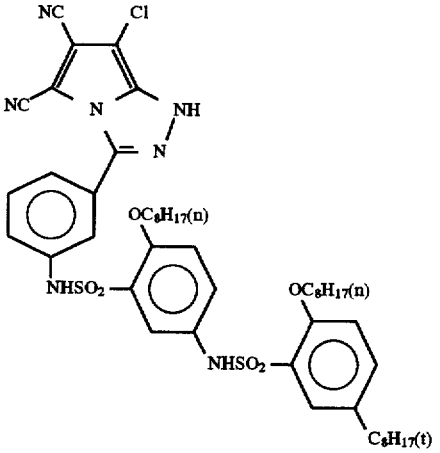
C-55
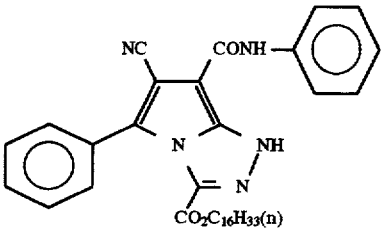
C-56
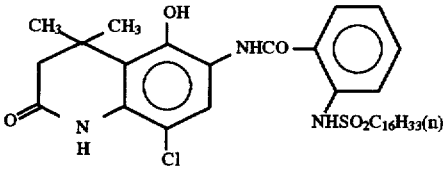
C-57
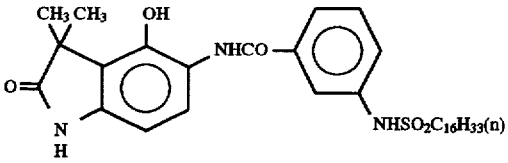
C-58
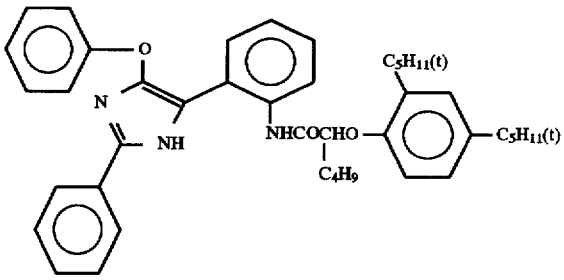
C-59
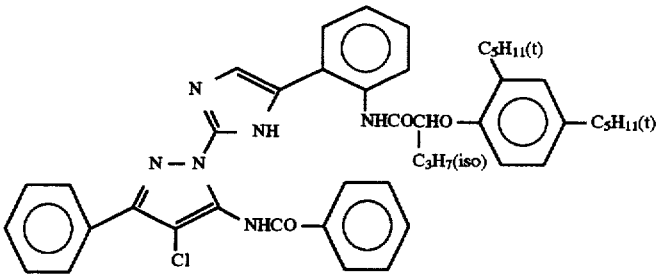

-continued
C-60
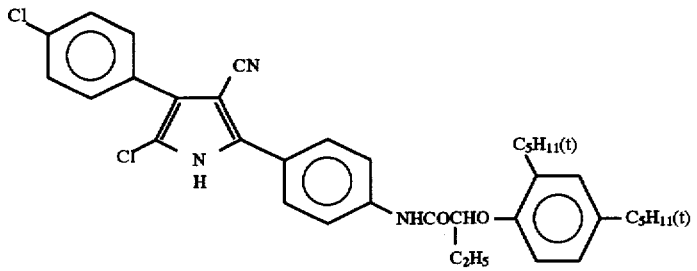
C-61
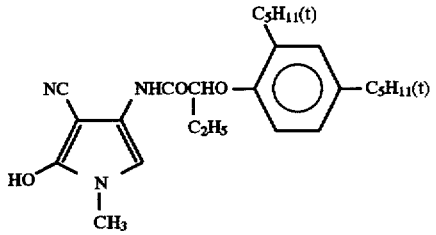
C-62
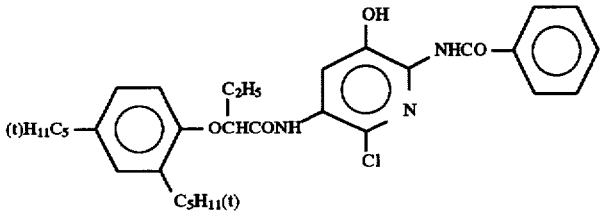
C-63
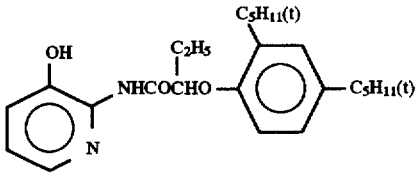
C-64
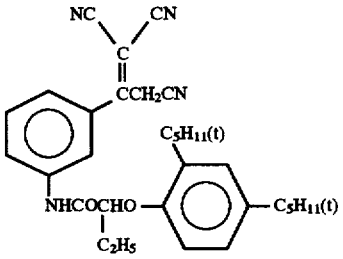
C-65
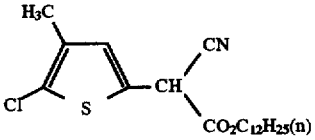
C-66
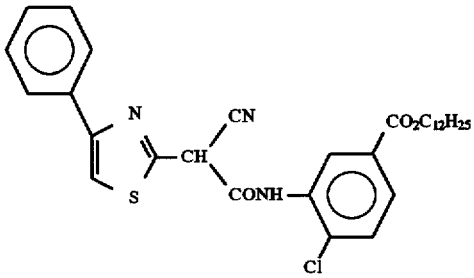
C-67
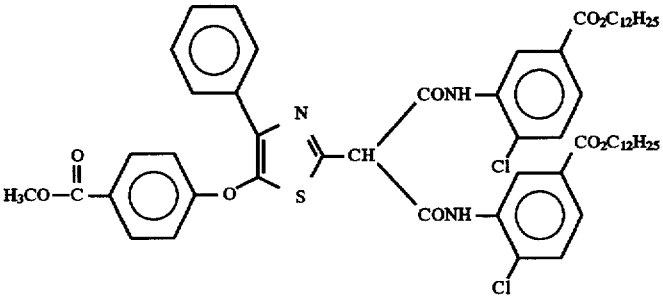

-continued
C-68
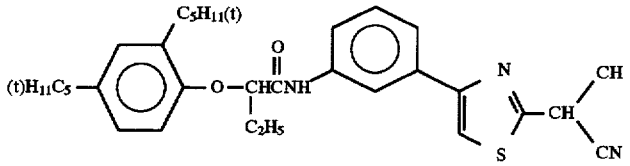
C-69
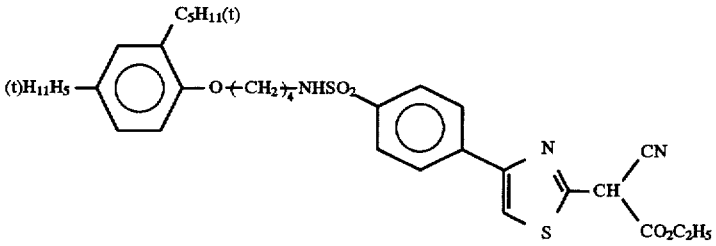
C-70
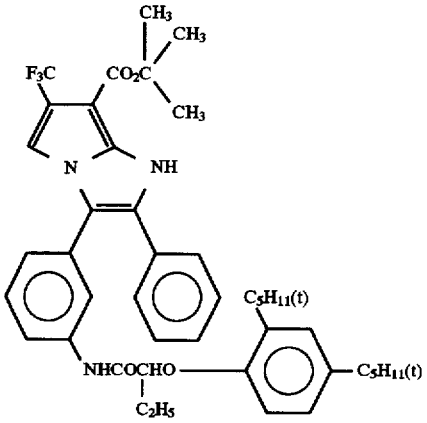
C-71
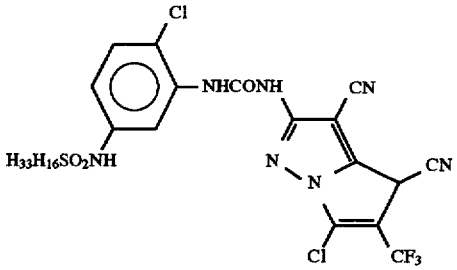
C-72
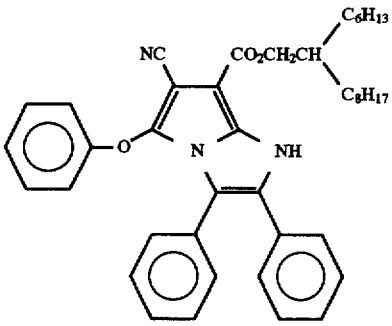
C-73
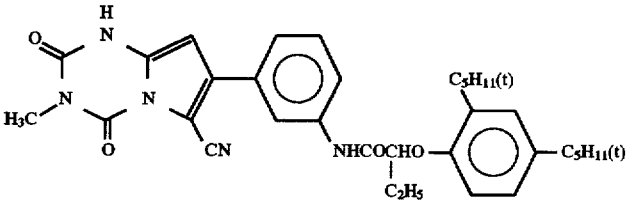

-continued

C-74

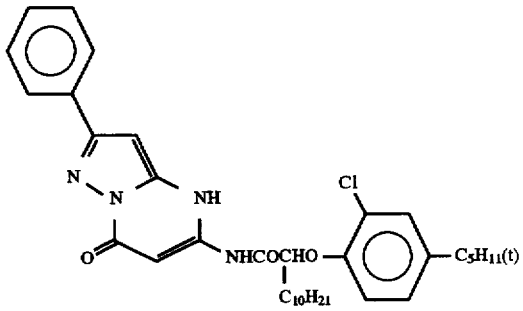

C-75

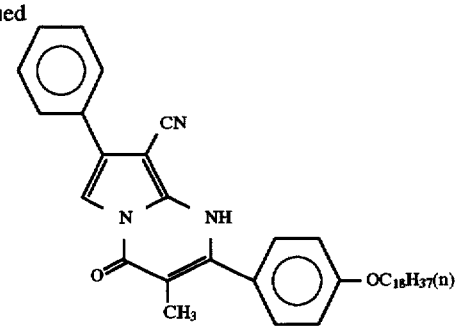

The coloring reducing agent and coupler of the present invention may be incorporated in the photographic light-sensitive material by various known dispersion methods. In particular, an oil-in-water dispersion method which comprises dissolving such a compound in a high boiling organic solvent (optionally in combination with a low boiling organic solvent), emulsion-dispersing the solution in an aqueous solution of gelatin, and then adding the emulsion dispersion to a silver halide emulsion is preferably used. As the high boiling organic solvent to be used in the present invention there may be any good solvent for coloring reducing agent and coupler which is a water-miscible compound having a melting point of not higher than 100° C. and a boiling point of not lower than 140° C. These high boiling organic solvents are further described in JP-A-62-215272, lower right column, page 137 to upper right column, page 144. The amount of the high boiling organic solvent to be used in the present invention may be arbitrary. However, the weight ratio of high boiling organic solvent to coloring reducing agent is preferably not more than 20, more preferably from 0.02 to 5.

Further, a known polymer dispersion method may be used in the present invention. The procedure and effect of latex dispersion method as one of polymer dispersion methods and latex for impregnation are described in U.S. Pat. No. 4,199,363, West German Patent Application (OLS) Nos. 2,541,274 and 2,541,230, JP-B-53-41091, and EP029104. A dispersion method with an organic solvent-soluble polymer is described in International Patent Publication No. WO88/00723.

The average size of the finely divided hydrophilic grains containing the coloring reducing agent of the present invention may be arbitrary. It is preferably from 0.05 to 0.3 μm, more preferably from 0.05 to 0.2 μm from the standpoint of color-developability.

The reduction of the average size of finely divided hydrophilic grains can be normally accomplished by properly selecting the kind of the surface active agent, increasing the amount of the surface active agent to be used, increasing the viscosity of the hydrophilic colloidal solution, reducing the viscosity of the hydrophilic organic layer by using a low boiling organic solvent as well, intensifying the shearing force by increasing the rotary speed of the agitating blade of the emulsifying apparatus, or prolonging the emulsifying time.

The size of the finely divided hydrophilic grains can be measured by means of a nanosizer available from Coal Tar Inc. of England.

The color photographic light-sensitive material of the present invention essentially comprises a light-sensitive silver halide emulsion, a dye-forming coupler, a coloring reducing agent, and a binder provided on a support. These components can be generally incorporated in the same layer but may be optionally separately incorporated in different layers.

In order to obtain a wide range of colors in the color chart from the three primaries, i.e., yellow, magenta and cyan, at least three silver halide emulsion layers which are sensitive to light in different spectral ranges may be used in combination. Examples of such a combination include a combination of a blue-sensitive layer, a green-sensitive layer and a red-sensitive layer, and a combination of a green-sensitive layer, a red-sensitive layer and an infrared-sensitive layer. These light-sensitive layers may be arranged in various orders known for ordinary color photographic light-sensitive materials. These light-sensitive layers may each be divided into two or more layers as necessary.

The amount of the dye-forming coupler in each layer is preferably from $1\times10^{-5}$ to $1.0\times10^{-2}$ mol/m$^2$, more preferably $1\times10^{-4}$ to $1\times10^{-3}$ mol/m$^2$.

The photographic light-sensitive material may comprise various auxiliary layers such as a protective layer, an undercoating layer, an interlayer, an antihalation layer and a back layer. The photographic light-sensitive material may further comprise various filter dyes incorporated therein to improve color separation.

The color photographic light-sensitive material to be used in the present invention preferably comprises at least one yellow-coloring silver halide emulsion layer, at least one magenta-coloring silver halide emulsion layer and at least one cyan-coloring emulsion layer coated on a support having a reflective layer. An ordinary color photographic paper comprises color couplers which produce dyes complementary to light to that the corresponding silver halide emulsions are sensitive to effect subtractive color reproduction. In such an ordinary color photographic paper, the foregoing coloring layers, i.e., a blue-sensitive layer, a green-sensitive layer and a red-sensitive layer have been spectrally sensitized with blue-sensitive, green-sensitive and red-sensitive spectral sensitizing dyes, respectively, and then applied to the support in the foregoing order. However, different orders of arrangement may be employed. Specifically, for example, it may be preferred that a light-sensitive layer containing silver halide grains having the greatest average size be disposed uppermost from the standpoint of rapid processing. Alternatively, it may be preferred that a magenta-coloring light-sensitive layer be disposed lowermost from the standpoint of preservability under radiation.

In a further alternative embodiment, the light-sensitive layers and the color hue of developed dyes may have correlations other than above specified. Further, at least one infrared-sensitive silver halide emulsion layer may be incorporated in the photographic light-sensitive material of the present invention.

As the support employable in the present invention there may be used any support to which the photographic emulsion layer can be applied, such as glass, paper and plastic films.

Examples of the plastic film employable in the present invention include a polyester film such as a polethylene terephthalate film, a polyethylene naphthalate film, a cellulose triacetate film and a cellulose nitrate film, a polyamide film, a polycarbonate film, and a polystyrene film.

A reflective support which can be used in the present invention is a support which exhibits an enhanced reflectivity to make the dye image formed on the silver halide emulsion layer sharp. Examples of such a reflective support include a hydrophobic resin having a light-reflecting substance such as titanium oxide, zinc oxide, calcium carbonate and calcium sulfate dispersed therein, and a support coated such a hydrophobic resin. Examples of such a reflective support include polyethylene-coated paper, polyester-coated paper, polypropylene synthetic paper, and support comprising a reflective layer or a reflective substance incorporated therein, such as a glass plate, a polyester film (e.g., a polyethylene terephthalate film, a cellulose triacetate film, a cellulose nitrate film), a polyamide film, a polycarbonate film, a polystyrene film and a vinyl chloride resin. As the polyester-coated paper there may be preferably used a polyester-coated paper comprising polyethylene terephthalate as a main component as described in EP0,507,489.

The reflective support to be used in the present invention is preferably a paper support coated with a water-resistant resin on both sides thereof, at least one of the water-resistant resins on both sides containing finely divided white pigment grains. These white pigment grains are preferably contained in the water-resistant resin layer in a density of 12% by weight or more, more preferably 14% by weight or more. As such light reflecting white pigment grains there are preferably used grains obtained by thoroughly kneading white pigment grains in the presence of a surface active agent, and optionally treating the surface of the pigment grains with a divalent, trivalent or tetravalent alcohol.

The photographic light-sensitive material of the present invention preferably comprises a support having a surface with a secondary diffused reflectivity. The term "secondary diffused reflectivity" as used herein means a diffused reflectivity obtained by roughening a mirror surface so that the mirror surface is divided into minute mirror surfaces facing in different directions. Regarding the roughness of the surface of the secondary diffused reflectivity, the three-dimensional average roughness with respect to the central surface is in the range of 0.1 to 2 μm, preferably 0.1 to 1.2 μm. For the details of such a support, reference can be made to JP-A-2-239244.

In the present invention, as the silver halide grains there may be used a mixed silver halide such as silver bromochloride, silver chloroiodide, silver bromoiodide and silver bromochloroiodide besides silver chloride or silver bromide. Preferred among these silver halides are silver chloride, silver bromochloride and silver bromochloroiodide having a silver chloride content of not less than 95 mol %.

In the present invention, iodine ion becomes a silver catalyst poison during the image intensification with hydrogen peroxide. From this point of view, silver bromochloride or silver chloride substantially free of silver iodide may be preferably used in the present invention. The term "substantially free of silver iodide" as used herein means a silver iodide content of 1 mol % or less, preferably 0.2 mol % or less, more preferably 0 mol %. On the other hand, for the purpose of enhancing the high intensity sensitivity, the spectrally sensitized sensitivity or the storage stability of the photographic light-sensitive material, high silver chloride content grains containing 0.01 to 3 mol % (preferably 0.01 to 0.1 mol %) of silver iodide on the surface thereof as disclosed in JP-A-3-84545 may be preferably used. The halogen composition of emulsion may be the same or different from grain to grain. The use of an emulsion having the same halogen composition among grains advantageously provides easy uniformization of the properties of grains. The halogen composition distribution in the silver halide emulsion grain can be properly selected from the group consisting of so-called uniform type structure in which the halogen composition is the same anywhere, so-called laminated structure in which the halogen composition differs from the core to the shell a single layer or plural layer, and structure in which nonlayer portions having different halogen compositions are localized inside or on the grains (portions having different halogen compositions are fused to the edge, corner or surface of the grains). In order to obtain a high sensitivity, the latter two structures are preferred to the uniform structure from the standpoint of pressure resistance. If the silver halide grains have such a structure, the border of the portions having different compositions may be a definite one or an indefinite one where a mixed crystal is formed by the difference in the halogen composition or a positively continuous structural change.

The high silver chloride content emulsion to be used in the present invention preferably comprises silver bromide phase localized inside silver halide grains and/or on the surface of silver halide grains in a layer or non-layer form as mentioned above. The halogen composition of the aforementioned localized phase preferably has a silver bromide content of at least 10 mol %, more preferably 20 mol %. The silver bromide content of the silver bromide localized phase can be analyzed by X-ray diffractometry (as described, e.g., in *Shinjikken Kagaku Koza* 6; *Kozo Kaiseki* (Lecture on New Experimental Chemistry 6; Structure Analysis), Nihon Kagakukai, Maruzen). These localized phases may be preferably present inside the grains, on the edge or corner of the surface of the grains, or on the surface of the grains. A preferred example is a localized phase epitaxially grown on the corner of grains.

It is also effective to further enhance the silver chloride content of the silver halide emulsion for the purpose of reducing the replenishment rate of the developer. In this case, a substantially pure silver chloride emulsion having a silver chloride content of 98 to 100 mol % may be preferably used.

The average grain size (number-average value of grain sizes as calculated in terms of diameter of circle having the same area as that of projected area of grains) of silver halide grains contained in the silver halide emulsion to be used in the present invention is preferably in the range of 0.02 to 2 μm, particularly 0.04 to 1.0 μm.

The grain size distribution is preferably so-called monodisperse, as represented by a fluctuation coefficient (obtained by dividing the standard deviation of grain size distribution by the average grain size) as small as 20% or less, more preferably 15% or less. For the purpose of obtaining a great latitude, several kinds of the aforementioned monodisperse emulsions may be preferably blended for one layer or may be preferably coated in multiple layers.

The silver halide grains to be contained in the photographic emulsion may have a regular crystal form such as cube, octahedron and tetradecahedron, an irregular crystal form such as sphere and tablet or composite thereof. The silver halide grains also may comprise a mixture of grains having various crystal forms. In the present invention, grains having the aforementioned regular crystal forms are generally contained in a weight proportion of 50% or more, preferably 70% or more, more preferably 90% or more.

Besides these emulsions, an emulsion comprising tabular grains having an average aspect ratio (diameter in terms of circle/thickness) of 5 or more, preferably 8 or more, in a weight proportion of 50% or more of the total grains as calculated in terms of projected area may be preferably used.

The preparation of silver (bromo)chloride emulsion to be used in the present invention can be accomplished by any suitable method as disclosed in P. Glafkides, *Chimie et Physique Photographique*, Paul Montel, 1967, G. F. Duffin, *Photographic Emulsion Chemistry*, The Focal Press, 1966, and V. L. Zelikman et al., *Making and Coating Photographic Emulsion*, The Focal Press, 1964.

The localized phase or substrate of the silver halide grains to be incorporated in the photographic light-sensitive material of the present invention may preferably comprise diverse metal ions or complex ions thereof. Preferred metal ions can be selected from the group consisting of ions of metals belonging to the groups VIII and IIb in the periodic table or complexes thereof, lead ions and thallium ions. The localized phase can mainly comprise metal ions selected from the group consisting of iridium, rhodium and ferric or ferrous ions or complex ions thereof. The substrate can mainly comprise metal ions selected from the group consisting of osmium, iridium, rhodium, platinum, ruthenium, palladium, cobalt, nickel and ferric or ferrous ions or complex ions in combination. The kind and concentration of metal ions can vary from the localized phase to the substrate. A plurality of kinds of metals can be used. In particular, iron and iridium compounds are preferably incorporated in the silver bromide localized phase.

These metal ion-supplying compounds may be incorporated in the localized phase and/or other portion (substrate) of the silver halide grains of the present invention by adding these metal ion-supplying compounds in the form of dispersion in aqueous solution of gelatin, aqueous solution of halide, aqueous solution of silver salt or other aqueous solutions to the system or by adding these metal ion-supplying compounds to the system in the form of finely divided silver halide grains containing metal ions so that the finely divided grains are dissolved in the system, during the formation of silver halide grains.

The incorporation of metal ions to be used in the photographic light-sensitive material of the present invention in the emulsion grains can be effected at any time before, during or shortly after the formation of grains depending on the position in the grain in which these metal ions are to be incorporated.

The silver halide emulsion to be used in the present invention is normally subjected to chemical sensitization and spectral sensitization.

The chemical sensitization of the photographic light-sensitive material of the present invention may be effected by a chemical sensitization with a chalcogen sensitizer (e.g., sulfur sensitization with an unstable sulfur compound, selenium sensitization with a selenium compound, tellurium sensitization with a tellurium compound), a noble sensitization other than gold sensitization, a reduction sensitization or the like as well as combinations thereof. As compounds to be used in the chemical sensitization method there may be preferably used those described in JP-A-62-215272, lower right column, page 18 to upper right column, page 22.

The constitution of the light-sensitive material of the present invention can exert a remarkably higher effect than when a highly chlorinated silver emulsion which has been gold-sensitized is used.

The emulsion to be used in the present invention is of a so-called surface latent image type in which latent images are formed mainly on the surface of grains.

The silver halide emulsion to be incorporated in the photographic light-sensitive material of the present invention may comprise various compounds or precursors thereof for the purpose of inhibiting fog during the preparation, storage or photographic processing of the photographic light-sensitive material. Specific examples of such compounds which can be preferably used in the present invention include those described in the above cited JP-A-62-215272, pp. 39 to 72. Further, 5-arylamino-1,2,3,4-thiatriazole compounds (the aryl residue contains at least one electrophilic group) as disclosed in EP0447647 may be preferably used.

In the photographic light-sensitive material of the present invention, the sum of coated amount of silver in all the coating layers is preferably from 0.003 to 0.3 g, more preferably from 0.01 to 0.10 g, further preferably from 0.015 to 0.050 g per $m^2$ in silver equivalence. The coated amount of silver in each of these light-sensitive layers is preferably from 0.001 to 0.1 g, more preferably from 0.003 to 0.03 g. In the present invention, the coated amount of silver in each of the light-sensitive layers is preferably not less than 0.001 g to obtain a sufficient image density, or preferably not more than 0.1 g to inhibit the rise in minimum density (Dmin) or inhibit the production of bubble.

Spectral sensitization may be effected for the purpose of providing the emulsion in the various layers in the photographic light-sensitive material of the present invention with the spectral sensitivity to the respective desired wavelength range.

As spectral sensitizing dyes to be used in the spectral sensitization to blue, green and red light ranges in the photographic light-sensitive material of the present invention there may be used those described in F. M. Harmer, *Heterocyclic compounds-Cyanine dyes and related compounds*, John Wiley & Sons, New York, London, 1964. Specific preferred examples of such a compound and spectral sensitization method which can be preferably used include those described in the above cited JP-A-62-215272, upper right column, pages 22–38. As the red-sensitive spectral sensitizing dye for silver halide emulsion grains having a high silver chloride content, spectral sensitizing dyes as disclosed in JP-A-3-123340 are particularly preferred from the standpoint of stability, adsorption, dependence of exposure on temperature, etc.

If the photographic light-sensitive material of the present invention is spectrally sensitized in the infrared range at a high efficiency, a sensitizing dye as disclosed in JP-A-3-15049, upper left column, page 12 to lower left column, page 21; JP-A-3-20730, lower left column, page 4 to lower left column, page 15; EP0,420,011, line 21, page 4 to line 54, page 6; EP0,420,012, line 12, page 4 to line 33, page 10; EP0,443,466, and U.S. Pat. No. 4,975,362 can be preferably used.

When such a spectral sensitizing dye is incorporated in the silver halide emulsion, it may be directly dispersed in the emulsion or may be added to the emulsion in the form of solution in water, methanol, ethanol, propanol, methyl cellosolve, 2,2,3,3-tetrafluoropropanol or the like, singly or in admixture. Alternatively, such a spectral sensitizing dye may be added to the emulsion in the form of aqueous solution with an acid or base present therein as disclosed in JP-B-44-23389, JP-B-44-27555, and JP-B-57-22089 or in the form of aqueous solution or colloidal dispersion with a surface active agent present therein as disclosed in U.S. Pat. Nos. 3,822,135, and 4,006,025. Further, such a spectral sensitizing dye may be dissolved in a solvent substantially immiscible with water such as phenoxyethanol, dispersed in water or a hydrophilic colloid, and then added to the emulsion. As described in JP-A-53-102733, and JP-A-58-105141, such a spectral sensitizing dye may be added to the emulsion in the form of dispersion in a hydrophilic colloid. The time at which such a spectral sensitizing dye is added to the emulsion may be any stage which has heretofore been known effective. In particular, it may be added to the emulsion before or during the formation of silver halide emulsion grains, between shortly after the formation of grains and before the rinse, before or during the chemical sensitization, between shortly after the chemical sensitization and cooling and solidification of the emulsion or during the preparation of coating solution. In general, it may be conducted between the completion of the chemical sensitization and before the coating. As described in U.S. Pat. Nos. 3,628,969, and 4,225,666, such a spectral sensitizing dye may be added to the emulsion at the same time with a chemical sensitizer so that spectral sensitization and chemical sensitization are simultaneously effected. As described in JP-A-58-113928, it may be conducted prior to the chemical sensitization. Further, such a spectral sensitizing dye may be added to the emulsion before the completion of precipitation and production of silver halide grains to initiate spectral sensitization. Moreover, as taught in U.S. Pat. No. 4,225,666, such a spectral sensitizing dye may be batch-wise added to the system. In other words, a part of the spectral sensitizing dye may be added to the system prior to chemical sensitization, and the residual part of the spectral sensitizing dye may be added to the system after chemical sensitization. In accordance with a further method taught in U.S. Pat. No. 4,183,756, such a spectral sensitizing dye may be added to the system at any stage during the formation of silver halide grains. Particularly preferred among these stages in which the spectral sensitizing dye can be added to the system is before rinse or chemical sensitization.

The amount of such a spectral sensitizing dye to be added depends much on the circumstances. It is preferably in the range of $0.5\times10^{-6}$ to $1.0\times10^{-2}$ mol, more preferably $1.0\times10^{-6}$ to $5.0\times10^{-3}$ mol per mol of silver halide.

In the photographic light-sensitive material of the present invention, if a sensitizing dye having a spectrally sensitized sensitivity particularly to the region between red range and infrared range is used, it is preferably used in combination with a compound as described in JP-A-2-157749, lower right column, page 13 to lower right column, page 22. The use of such a compound provides a specific enhancement of the preservability and processing stability of the photographic light-sensitive material and the effect of supersensitizing the photographic light-sensitive material. In particular, Compounds (IV), (V) and (VI) described in the above cited reference are preferably used. The amount of such a compound to be incorporated is in the range of $0.5\times10^{-5}$ to $5.0\times10^{-2}$ mol, preferably $5.0\times10^{-5}$ to $5.0\times10^{-3}$ mol, per mol of silver halide. Its advantageous range is in the range of 0.1 to 10,000 mols, preferably 0.5 to 5,000 mols, per mol of sensitizing dye.

The photographic light-sensitive material of the present invention may be used in a print system employing an ordinary negative printer. In addition, the photographic light-sensitive material of the present invention may be preferably used in a digital scanning exposure system employing a high density monochromatic light from a gas laser, light-emitting diode, semi-conductor laser, second harmonic wave generating light source (SHG) having a semi-conductor laser or solid laser comprising semi-conductor laser as an excitation light source and a non-linear optical crystal in combination, or the like. In order to a compact and cheap system, a semi-conductor laser or a second harmonic wave generating light source (SHG) having a semi-conductor laser or solid laser and a non-linear optical crystal in combination may be preferably used. In particular, in order to design a compact, cheap, long-lived highly stable apparatus, a semi-conductor laser is preferably used. It is preferred that at least one of exposing light sources be a semi-conductor laser.

If such a scanning exposure light source is used, the maximal spectral sensitivity of the photographic light-sensitive material of the present invention may be arbitrarily determined depending on the wavelength of the scanning exposing light used. A solid laser comprising a semi-conductor laser as an excitation light source or an SHG light source obtained by combining a semi-conductor laser and a non-linear optical crystal can emit a laser light having a halved oscillation wavelength to obtain blue light or green light. Accordingly, the maximal spectral sensitivity of the photographic light-sensitive material can be disposed in ordinary three regions, i.e., blue, green and red regions. If a semi-conductor laser is used as a light source to provide a compact, cheap, highly stable apparatus, it is preferred that at least two layers have a maximal spectral sensitivity in the range of not less than 670 mm. This is because that the wavelength range of light emitted by a currently available cheap and stable III-V Group semi-conductor laser is disposed only in the region ranging from red to infrared. However, in a laboratory level, II-VI Group semi-conductor lasers were confirmed to oscillate in green and blue regions. It can be sufficiently expected that if the technique for production of semi-conductor lasers is developed, these semi-conductor lasers would be used cheap and stably. In this case., the necessity that at least two layers have a maximal spectral sensitivity in the range of not less than 670 mm is lessened.

In this scanning exposure, the time required for silver halide in the photographic light-sensitive material to be exposed is the time required for a minute area to be exposed. As this minute area there is normally used a minimum unit on which the amount of light is controlled by its respective digital data. This minimum unit is called pixel. Accordingly, the exposure time per pixel varies with the size of pixel. The size of pixel depends on the pixel density and is actually from 50 to 2,000 dpi. If the exposure time is defined as the time required for a pixel density of 400 dpi as pixel size to be exposed, it is preferably not more than $10^{-4}$ seconds, more preferably not more than $10^{-6}$ seconds.

The photographic light-sensitive material according to the present invention may preferably comprise a dye that can be decolored upon processing (particularly an oxonol dye and a cyanine dye) as described in EP0337490A2, pp. 27–76, incorporated in the hydrophilic colloidal layer for the purpose of inhibiting irradiation or halation or enhancing stability to safelight.

Among these water-soluble dyes is one which deteriorates color separation or stability to safelight when used in an increased amount. As a dye which can be used without deteriorating color separation there may be preferably used a water-soluble dye as described in JP-A-5-216185, JP-A-5-127325, and JP-A-5-127324.

In the present invention, a colored layer which can be decolored upon processing may be used instead of or in combination with such a water-soluble dye. The colored layer which can be decolored upon processing may be disposed in such an arrangement that it is brought into contact with the emulsion layer directly or via an interlayer containing a processing stain inhibitor such as gelatin and hydroquinone. This colored layer is preferably disposed under the emulsion layer which develops the same kind of primary color as the color of the colored layer (support side). The colored layer color may be provided every color. Alternatively, the colored layer may be provided only for some colors. Further, a colored layer colored for a plurality of primary color ranges may be provided. The optical reflection density of the colored layer is preferably from not less than 0.2 and not more than 3.0, more preferably from not less than 0.5 and not more than 2.5, particularly from not less than 0.8 and not more than 2.0, at the wavelength where the highest optical density can be obtained in the wavelength range used for exposure (visible light range of from 400 to 700 nm in the ordinary printer exposure or wavelength range of the scanning exposure light source used in scanning exposure).

In order to form the colored layer, known methods can be applied. Examples of these known methods include a method which comprises the incorporation of a dye in the hydrophilic colloidal layer in the form of fine solid dispersion as described in JP-A-2-182244, upper right column, page 3 to page 8, and JP-A-3-7931, upper right column, page 3 to lower left column, page 11, a method which comprises mordanting a cationic polymer with an anionic dye, a method which comprises fixing a dye in a layer in the form of adsorption on finely divided gains of silver halide or the like, and a method which comprises the use of colloidal silver as described in JP-A-1-239544. As the method which comprises the fine solid dispersion of a dye there is described a method which comprises the incorporation of a finely divided dye powder which is substantially water-insoluble at pH 6 or less but is substantially water-soluble at pH 8 or more in JP-A-2-308244, pp. 4–13. An example of the method which comprises mordanting a cationic polymer with an anionic dye is described in JP-A-2-84637, pp. 18–26. A process for the preparation of colloidal silver as a light absorber is described in U.S. Pat. Nos. 2,688,601 and 3,459,563. Preferred among these methods are the method which comprises the incorporation of a finely divided dye powder and the method which comprises the use of colloidal silver.

As the binder or protective colloid to be incorporated in the photographic light-sensitive material according to the present invention there can be advantageously used gelatin. Other hydrophilic colloids may be used singly or in combination with gelatin. As gelatin there may be preferably used a low calcium content gelatin having a calcium content of not more than 800 ppm, more preferably not more than 200 ppm. In order to block various mildew or bacteria which propagate themselves in the hydrophilic colloidal layer to deteriorate the image, a mildewproofing agent as described in JP-A-63-271247 is preferably incorporated in the photographic light-sensitive material.

When the photographic light-sensitive material of the present invention is exposed to printer exposure, a band stop filter as described in U.S. Pat. No. 4,880,726 is preferably used. This can eliminate optical stain, remarkably enhancing color reproducibility.

The photographic light-sensitive material which has been exposed to light is then subjected to common color development. The color photographic light-sensitive material of the present invention which has been subjected to color development is preferably then subjected to washing or stabilization for the purpose of rapid processing. In particular, if the foregoing highly chlorinated silver emulsion is used, the pH value of the blix bath is preferably not more than about 6.5, more preferably not more than about 6 for the purpose of accelerating desilvering.

As the silver halide emulsion, other materials (additives, etc.) and photographic constituent layers (including the order of layer arrangement) to be incorporated in the photographic light-sensitive material according to the present invention and processing method and processing additives which can be used to process the photographic light-sensitive material of the present invention there may be preferably used those described in EP0,355,660A2 (JP-A-2-139544).

A cyan, magenta or yellow coupler is preferably emulsion-dispersed in an aqueous solution of hydrophilic colloid in the form of impregnation in a loadable latex polymer (as described in U.S. Pat. No. 4,203,716) with (or free of) a high boiling organic solvent or in the form of solution with a water-insoluble and organic solvent-soluble polymer. Examples of water-insoluble and organic solvent-soluble polymer which can be preferably used include homopolymers and copolymers described in U.S. Pat. No. 4,857,449, 7th column to 15th column, and International Patent Publication No. WO88/00723, pp. 12–30. More preferably, methacrylate or acrylamide polymers, particularly acrylamide polymers, may be used from the standpoint of dye image stability.

The processing elements and processing methods to be used in the present invention will be further described hereinafter. In the present invention, the photographic light-sensitive material is subjected to development (silver development/cross oxidation of incorporated reducing agent), desilvering, and rinsing or stabilization. The rinsing or stabilization may be followed by a processing step for intensifying color development such as provision with alkali.

The developer for developing the photographic light-sensitive material of the present invention comprises a compound which acts as a silver halide developing agent and/or, upon silver development, produces an oxidation product of the developing agent which then cross-oxidizes a coloring reducing agent incorporated in the photographic light-sensitive material. Preferred examples of such a compound include pyrazolidone compounds, dihydroxybenzene compounds, reductone compounds, and aminophenol compounds. Particularly preferred among these compounds are pyrazolidone compounds.

Preferred among these pyrazolidone compounds are 1-phenyl-3-pyrazolidone compounds. Preferred examples of 1-phenyl-3-pyrazolidone compounds include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-phenyl-5-phenyl-3-pyrazolidone, 1-p-tollyl-4-methyl-4-hydroxymethyl-3-pyrazolidone, 1-p-chlorophenyl-4-methyl-4-hydroxymethyl-3-pyrazolidone, 1-phenyl-2-hydroxymethyl-4,4-dimethyl-3-pyrazolidone, 1-phenyl-2-acetyl-3-pyrazolidone, and 1-phenyl-2-hydroxymethyl-5-phenyl-3-pyrazolidone.

Examples of the dihydroxybenzene compounds include hydroquinone, chlorohydroquinone, bromohydroquinone, isopropylhydroquinone, methylhydroquinone, 2,3-dichlorohydroquinone, 2,5-dichlorohydroquinone, 2,5-dimethylhydroquinone, and potassium hydroquinonemonosulfonate.

Preferred examples of the reductone compounds include ascorbic acid and derivatives thereof. For example, compounds as described in JP-A-6-148822, pp. 3–10, may be used. In particular, sodium L-ascorbate and sodium erythorbate are preferred.

Examples of the p-aminophenol compounds include N-methyl-p-aminophenol, N-(β-hydroxyethyl)-p-aminophenol, N-(4-hydroxyphenyl)glycine, and 2-methyl-p-aminophenol.

These compounds are normally used singly but are preferably used in combination to enhance developability and cross-oxidation activity.

The amount of such a compound to be incorporated in the developer is generally from $2.5\times10^{-4}$ to 0.2 mol/l, preferably from 0.0025 to 0.1 mol/l, more preferably from 0.001 to 0.05 mol/l.

In the present invention, if the photographic light-sensitive material comprises an auxiliary developing agent such as pyrazolidone compounds incorporated therein, the developer is preferably free of the foregoing developing agent. In other words, the photographic light-sensitive material of the present invention is preferably processed with an intensifier-containing alkaline solution free of auxiliary developing agent. Such an intensifier-containing solution free of auxiliary developing agent will be also referred to as a "developer" or "development intensifier" Examples of the intensifier which can be used in the present invention include peroxides, halogenous acids, iodoso compounds and cobalt (III) complex compounds as described in West German Patents (OLS) 1,813,920, 2,044,993, and 2,735,262, JP-A-48-9728, JP-A-49-84240, JP-A-49-102314, JP-A-51-53826, JP-A-52-13336, and JP-A-52-73731. Particularly preferred among these intensifiers is hydrogen peroxide, which provides a high intensification.

In the present invention, a compound which releases hydrogen peroxide, such as perboric acid and percarbonic acid, is also preferred. The developer generally contains hydrogen peroxide in an amount of from 0.005 to 1 mol/l, preferably from 0.01 to 0.5 mol/l, more preferably from 0.02 to 0.25 mol/l.

The developer used in the present invention is an alkali solution containing an intensifier, and may further contain the following various compounds.

Examples of a preservative to be incorporated in the developer of the present invention include sodium sulfite, potassium sulfite, lithium sulfite, ammonium sulfite, sodium bisulfite, potassium metabisulfite, formaldehyde sodium bisulfite, and hydroxylamine sulfate. The amount of such a preservative to be incorporated is generally not more than 0.1 mol/l, preferably from 0.001 to 0.02 mol/l. If the photographic light-sensitive material comprises a highly chlorinated silver emulsion incorporated therein, the foregoing preservative is used in an amount of not more than 0.001 mol/l, preferably none.

In the present invention, the photographic light-sensitive material preferably comprises an organic preservative incorporated therein instead of the foregoing hydroxylamine or sulfite ion.

The organic preservative as used herein generally indicates organic compounds which reduce the rate of deterioration of the foregoing developing agent when added to the developer, that is, organic compounds that act to inhibit the oxidation of the developing agent by air or the like. Particularly preferred among these organic preservatives are hydroxylamine derivatives (excluding hydroxylamine), hydroxamic acids, hydrazines, phenols, α-hydroxyketones, α-aminoketones, saccharides, monoamines, diamines, polyamines, quaternary ammoniums, nitroxy radicals, alcohols, oxims, diamide compounds, and condensed ring amines. These organic preservatives are described in JP-A-63-4235, JP-A-63-5341, JP-A-63-30845, JP-A-63-21647, JP-A-63-44655, JP-A-63-46454, JP-A-63-58346, JP-A-63-43138, JP-A-63-146041, JP-A-63-44657, JP-A-63-44656, U.S. Pat. Nos. 3,615,503 and 2,494,903, JP-B-48-30496. As other preservatives there may be optionally used various metals as described in JP-A-57-44148 and JP-A-57-53749, salicylic acids as described in JP-A-59-180588, alkanolamines as described in JP-A-54-3532, polyethyleneimines as described in JP-A-56-94349, aromatic polyhydroxyl compounds as described in U.S. Pat. No. 3,746,544, etc. In particular, alkanolamines as described in JP-A-4-97355, pp. 631–632, and dialkylhydroxylamines as described in JP-A-4-97355, pp. 627–630, are preferred. Further, dialkylhydroxylamines and/or hdyrazines and alkanolamine are preferably used in combination. Alternatively, dialkylhydroxylamine as described in EP0530921A1 and α-amino acid such as glycine are preferably used in combination.

The amount of such a compound to be used is preferably from $1\times10^{-3}$ to $5\times10^{-1}$ mol, more preferably from $1\times10^{-2}$ to $2\times10^{-1}$ mol per l of the developer.

In the present invention, the developer comprises halogen ions such as chlorine ion, bromine ion and iodine ion incorporated therein. In particular, if a highly chlorinated silver emulsion is used, chlorine ion is preferably incorporated in the developer in an amount of from $3.5\times10^{-3}$ to $3.0\times10^{-1}$ mol/l, more preferably from $1\times10^{-2}$ to $2\times10^{-1}$ mol/l. In addition or alternatively, bromine ion is preferably incorporated in the developer in an amount of from $0.5\times10^{-5}$ to $1.0\times10^{-3}$ mol/l, more preferably from $3.0\times10^{-5}$ to $5\times10^{-4}$ mol/l.

The halide may be directly incorporated in the developer or may be eluted from the photographic light-sensitive material with the developer during development.

When the halide is incorporated in the developer, the halide is supplied in the form of sodium salt, potassium salt, ammonium salt, lithium salt or magnesium salt.

When the halide is eluted from the light-sensitive material, the halide is mainly supplied from the silver halide emulsion but may be supplied from other constituent elements.

The pH value of the developer to be used in the present invention is preferably from 8 to 13, more preferably from 9 to 12.

In order to keep the pH value of the developer in the above defined range, the developer of the present invention preferably comprises various buffers incorporated therein. Examples of these buffers employable herein include carbonate, phosphate, borate, tetraborate, hydroxybenzoate, glycyl salt, N,N-dimethylglycine salt, leucine salt, norleucine salt, guanine salt, 3,4-dihydroxyphenylalanine salt, alanine salt, aminobutyric acid, 2-amino-2-methyl-1,3-propanediol salt, valine salt, proline salt, trishydroxyaminomethane salt, and lysine salt. In particular, carbonate, phosphate, tetraborate, and hydroxybenzoate are preferably used because they have an excellent solubility and an excellent buffering capacity in a pH range of not less than 9.0 and have no adverse effects on the photographic properties when added to the developer.

Specific examples of such buffers include lithium carbonate, sodium carbonate, potassium carbonate, sodium bicarbonate, tripotassium phosphate, trisodium phosphate, dipotassium phosphate, disodium phosphate, potassium borate, sodium borate, sodium tetraborate, potassium tetraborate, sodium o-hydroxbenzoate (sodium salicylate), and potassium 5-sulfo-2-hydroxybenzoate (potassium 5-sulfosalicylate).

The amount of the buffer to be incorporated in the developer is preferably in the range of not less than 0.05 mol/l, particularly from 0.1 to 0.4 mol/l.

The developer may further comprise various chelating agents as calcium or magnesium suspending agents or to improve the stability of the developer. Specific examples of such organic acid compounds include nitrilotriacetic acid, diethylenetriaminepentaacetic acid, ethylenediamine tetraacetic acid, N,N,N-trimethylenephosphonic acid, ethylenediamine-N,N,N',N'-tetramethylenesulfonic acid, 1,2-diaminopropanetetraacetic acid, glycoletherdiaminetetraacetic acid, ethylenediamineorthohydroxyphenylacetic acid, 2-phosphonobutane-1,2,4-tricarboxylic acid, 1-hydroxyethylidene-1,1-diphosphonic acid, 1,2-dihydroxybenzene-4,6-disulfonic acid, and alkaline metal salts thereof. These chelating agents may be used in combination as necessary.

The proper amount of such a chelating agent to be incorporated in the color developer is such that it suffices to block metallic ions in the color developer, e.g., 0.1 to 10 g/l.

In the present invention, any fog inhibitors may be incorporated in the developer as necessary. As such fog inhibitors there can be used a halide of alkaline metal such as sodium chloride, potassium bromide and potassium iodide or nitrogen-containing heterocyclic compound. Typical examples of such a nitrogen-containing heterocyclic compound include benzotriazole, 5-nitrobenzotriazole, 5-methylbenzotriazole, 6-nitrobenzimidazole, 5-nitroisoimidazole, 2-thiazolyl-benzimidazole, indazole, hydroxyazaindolidine, adenine, 1-phenyl-5-mercaptotetrazole, and derivatives thereof.

The amount of such a nitrogen-containing heterocyclic compound to be incorporated is generally from $1\times10^{-5}$ to $1\times10^{-2}$ mol/l, preferably from $2.5\times10^{-5}$ to $1\times10^{-3}$ mol/l.

The developer may optionally comprise any development accelerators. Examples of development accelerators which can be incorporated in the developer include thioether compounds as disclosed in JP-B-37-16088, JP-B-37-5987, JP-B-38-7826, JP-B-44-12380, and JP-B-45-9019, and U.S. Pat. No. 3,813,247, p-phenylenediamine compounds as disclosed in JP-A-52-49829 and JP-A-50-15554, tertiary ammonium salts as disclosed in JP-A-50-137726, JP-A-56-156826 and JP-A-52-43429, and JP-B-44-30074, amine compounds as disclosed in U.S. Pat. Nos. 2,494,903, 3,128,182, 4,230,796, 3,253,919, and 2,482,546, and JP-B-41-11431, polyalkylene oxides as disclosed in JP-B-37-16088, JP-B-42-25201, JP-B-41-11431, and JP-B-42-23883, and U.S. Pat. Nos. 3,128,183, and 3,532,501, and imidazoles.

The developer to be used in the present invention preferably comprises a fluorescent brightening agent. As such a fluorescent brightening agent there can be preferably used 4,4'-diamino-2,2'-disulfostilbene compound. In some detail, commercially available fluorescent brightening agents such as compounds described in *Senshoku Note: 19th Edition* (Dye Note: 19th Edition), pp. 165–168, and JP-A-4-242943, pp. 3–7. The amount of such a fluorescent brightening agent to be incorporated in the color developer is in the range of from 0.1 to 10 g/l, preferably 0.5 to 5 g/l.

The temperature at which the present processing is effected with the developer is in the range of 20° to 50° C., preferably 30° to 45° C. The time during which the present processing is effected with the developer is in the range of 5 seconds to 2 minutes, preferably 10 seconds to 1 minute. The replenishment rate of the developer is preferably predetermined to a small value. Its proper value is in the range of from 15 to 600 ml, preferably from 25 to 200 ml, more preferably from 35 to 100 ml. Alternatively, a percarbonic acid or perboric acid may be added in the form of powder as it is so that no replenishment is required.

The photographic light-sensitive material which has been developed is then normally subjected to desilvering. In the present invention, however, it is also preferred that the photographic light-sensitive material which has been developed be stabilized or rinsed without being desilvered. In particular, the photographic light-sensitive material which has been developed is preferably processed in a stabilizing bath as described in JP-B-63-20330 and JP-A-63-20332. In other words, in accordance with the present invention, the amount of silver to be incorporated in the photographic light-sensitive material can be drastically reduced, eliminating the need of bleaching and the discharge of silver (or silver salt) from the stabilization step. Thus, the processing method which can be employed in the present invention is preferred from the standpoint of environmental protection.

Examples of the desilvering method, if conducted following the development, include a method which comprises fixing, and a method which comprises bleaching and fixing. In the latter case, bleaching and fixing may be effected separately or simultaneously (blix). Further, the photographic light-sensitive material which has been developed may be arbitrarily effected in a blix bath consisting of two continuous baths, fixed before blix, or bleached after blix depending on the purpose.

Examples of bleaching agents to be incorporated in the bleaching bath or blix bath include compounds of polyvalent metals, e.g., iron (III), cobalt (III), chromium (IV), copper (II), peroxides, quinones, and nitro compounds. Typical examples of these bleaching agents include iron chloride, ferricyanide compounds, bichromates, organic complex salts of iron (III) (e.g., with ethylenediamine tetraacetic acid, diethylenetriaminepentaacetic acid, cyclohexanediaminetetraacetic acid, 1,3-diaminopropane tetraacetic acid, methyliminodiacetic acid, and aminocarboxylic acids as described in JP-A-4-365036, pp. 5–17), persulfates, permanganates, bromates, hydrogen peroxide, hydrogen peroxide-releasing compounds (percarbonic acid, perboric acid, etc.), and nitrobenzenes. Of these, ferric aminopolycarboxylate such as ferric ethylenediaminetetraacetate complex salt and ferric 1,3-diaminopropanetetraacetate complex salt, hydrogen peroxide, persulfates are preferred in view of speeding up of processing and conservation of the environment.

The pH value of a bleaching solution or blix solution comprising such a ferric aminopolycarboxylate complex salt is normally in the range of from 3 to 8, preferably from 5 to 7. The pH value of a bleaching solution comprising such a persulfate or hydrogen peroxide is normally in the range of from 4 to 11, preferably from 5 to 10.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, West German Patent 1,290,812, JP-A-53-95630, and Research Disclosure No. 17129 (July 1978), thiazolidine derivatives as described in JP-A-50-140129, thiourea derivatives as described in U.S. Pat. No. 3,706,561, iodides as described in JP-A-58-16235, polyoxyethylene compounds as described in West German Patent 2,748,430, polyamine compounds as described in JP-B-45-8836, and bromide ions.

Preferred among these compounds are compounds containing a mercapto group or disulfide group because of their great acceleratory effects. These bleaching accelerators are particularly effective for desilvering of color photographic light-sensitive materials for picture taking.

As the accelerator for bleach with persulfate there can be effectively used a complex salt of ferric ion with 2-pyridinecarboxylic acid or 2,6-pyridinedicarboxylic acid as described in JP-A-6-214365 (EP0602600A1). As the accelerator for bleach with hydrogen peroxide there can be effectively used a complex salt of organic acid with metal as described in JP-B-61-16067 and JP-B-61-19024.

The bleaching bath, blix bath or fixing bath may comprise known additives such as rehalogenating agent (e.g., ammonium bromide, ammonium chloride), pH buffer (e.g., ammonium nitrate, acetic acid, boric acid, citric acid, salt thereof, tartaric acid, salt thereof, succinic acid, salt thereof, imidazole) and metal corrosion inhibitor (e.g., ammonium sulfate) incorporated therein. In particular, an organic acid is preferably incorporated in these baths to inhibit bleach stain. As such an organic acid there may be used a compound having an acid dissociation constant (pKa) of from 2 to 7. Specific examples of such a compound include acetic acid, succinic acid, citric acid, and propionic acid.

Examples of the fixing agent to be incorporated in the fixing bath or blix bath include thiosulfate, thiocyanate, thiourea, iodide (to be used in a large amount), nitrogen-containing heterocyclic compounds containing sulfide group as described in JP-A-4-365037, pp. 11–21, JP-A-5-66540, pp. 1088–1092, mesoionic compounds, and thioether compounds. Among these compounds, thiosulfate is normally used. Ammonium thiosulfate can be most frequently used. Further, thiosulfate may be preferably used in combination with thiocyanate, thioether compound, thiourea, mesoionic compound or the like.

As the preservative for fixing bath or blix bath there may be preferably used a sulfite, bisulfite, carbonyl-bisulfurous acid adduct or sulfinic compound as described in EP294769A. Further, the fixing bath, bleaching bath or blix bath preferably comprises various aminopolycarboxylic acids, organic phosphonic acids (e.g., 1-hydroxyethylidene-1,1-diphosphonic acid, N,N,N',N'-ethylenediaminetetraphosphonic acid, 2-phosphonobutane-1,2,4-tricarboxylic acid) or sodium titanate incorporated therein for the purpose of stabilizing the bath.

The fixing bath or blix bath may further comprise various fluorescent brightening agents, various anti-foaming agents, various surface active agents, polyvinyl pyrrolidone, methanol, etc. incorporated therein.

The desilvering temperature is generally from 20° to 50° C., preferably from 30° to 45° C. The desilvering time is from 5 seconds to 2 minutes, preferably from 10 seconds to 1 minute. The replenishment rate at the desilvering step is preferably as low as possible. It is from 15 to 600 ml, preferably from 25 to 200 ml, particularly from 35 to 100 ml per $m^2$ of the photographic light-sensitive material. It is also preferred that desilvering be effected without replenishment of a fixing solution or the like but making up for the evaporation loss at most.

The photographic light-sensitive material of the present invention which has been desilvered is normally then subjected to rinsing. If the photographic light-sensitive material is subjected to stabilization, it may not be subjected to rinsing. For this stabilization, any of methods as described in JP-A-57-8543, JP-A-58-14834, JP-A-60-220345, JP-A-58-127926, JP-A-58-137837, and JP-A-58-140741 may be employed. A rinsing-stabilizing step using a stabilizing bath containing a dye stabilizer and a surface active agent as a final bath as used in the processing of color photographic light-sensitive material for picture taking may be effected.

The rinsing bath or stabilizing bath may comprise a water hardener such as sulfite, inorganic phosphoric acid, polyaminocarboxylic acid and organic aminophosphonic acid, metallic salt such as magnesium salt, aluminum salt and bismuth salt, surface active agent, film hardener, pH buffer, fluorescent brightening agent, silver salt-forming agent such as nitrogen-containing heterocyclic compound, etc.

Examples of the dye stabilizer to be incorporated in the stabilizing bath include aldehydes such as formalin and glutaraldehyde, N-methylol compound, hexamethylene tetramine, and aldehyde-sulfurous acid adduct.

The pH value of the rinsing bath or stabilizing bath is generally from 4 to 9, preferably from 5 to 8. The processing temperature is generally from 15° to 45° C., preferably from 25° to 40° C. The processing time is generally from 5 seconds to 2 minutes, preferably from 10 seconds to 40 seconds.

The overflow solution produced with the replenishment of the foregoing rinsing and/or stabilizing step can be re-used in other steps such as desilvering step.

The amount of rinsing solution and/or stabilizing solution can widely vary with various conditions. The replenishment rate for rinsing and/or stabilizing bath is preferably from 15 to 360 ml, more preferably from 25 to 120 ml per $m^2$ of the photographic light-sensitive material. In order to reduce the replenishment rate, it is preferred that the processing be effected in a multi-stage countercurrent process using a plurality of tanks. In particular, 2 to 5 tanks are preferably used. In order to inhibit the propagation of bacteria caused by the reduction of the amount of water or the attachment of the resulting floating masses of bacteria to the photographic light-sensitive material, bactericides such as isothiazolone compounds or thiabenzazoles as described in JP-A-57-8542 and chlorinated isocyanurate, benzotriazole, and bactericides described in Hiroshi Horiguchi, *Bokinbobaizai no Kagaku* (Chemistry of Antibacillus and Antifungal) (1986), Eisei Gijutsu Gakkai (ed.), *Biseibutsu no Mekkin, Sakkin, Bobaigijutsu* (Sterilization and Antifungal of Miroorganisms) (1982), and Nippon Bokin Bobi Gakkai (ed.), *Bokin Bobaizai Jiten* (Encyclopedia of Antibacillus and Antifungal) (1986) may be used. Further, a method for reducing Mg or Ca ions as described in JP-A-62-288838 may be preferably used in particular.

In the present invention, water obtained by treating the overflow solution or tank solution through a reverse osmosis membrane can be used to save water. The treatment by reverse osmosis is preferably conducted for water in the second tank or following tanks in the multi-stage countercurrent rinsing and/or stabilizing step. In some detail, in the case of 2-tank system, water in the second tank may be treated through a reverse osmosis membrane. In the case of 4-tank system, water in the third or fourth tank may be treated through a reverse osmosis membrane. The water which has permeated through the reverse osmosis membrane is then returned to the original tank (tank from which the water to be treated through the reverse osmosis membrane has been withdrawn) or the following rinsing tank and/or stabilizing tank for re-use. The solution thus concentrated is then returned to above the original tank, even to the desilvering bath.

Examples of the material of the reverse osmosis membrane which can be used include cellulose acetate, crosslinked polyamide, polyether, polysulfone, polyacrylic acid, and polyvinylene carbonate.

The liquid supply pressure with this membrane is preferably from 2 to 10 kg/$cm^2$, particularly from 3 to 7 kg/$cm^2$.

In the present invention, the agitation is preferably intensified as much as possible. Specific examples of such an agitation intensifying method include a method as described in JP-A-62-183460 and JP-A-62-183461 which comprises jetting the processing solution to the surface of the emulsion layer in the light-sensitive material, a method as described in JP-A-62-183461 which comprises improving the agitating effect by a rotary means, a method which comprises improving the agitating effect by moving the light-sensitive material with the emulsion surface in contact with a wiper blade provided in the bath so that a turbulence occurs on the emulsion surface, and a method which comprises increasing the total circulated amount of processing solution. Such an agitation improving method can be effectively applied to the developer bath, bleaching bath, fixing bath, blix bath, stabilizing bath or rinsing bath. These methods are effective for the acceleration of the supply of effective components from the solution into the photographic light-sensitive material or the diffusion of unnecessary components of the photographic light-sensitive material.

The present invention can exhibit excellent properties even when any of these baths has any opening ratio represented by the following equation:

$$\text{opening ratio } (\text{cm}^{-1}) = \frac{\text{area of contact with air } (\text{cm}^2)}{\text{liquid volume } (\text{cm}^3)}$$

From the standpoint of stability of liquid components, the opening ratio is preferably from 0 to 0.1 $\text{cm}^{-1}$. In the continuous processing, the practical opening ratio is preferably from 0.001 to 0.05 $\text{cm}^{-1}$, more preferably from 0.002 to 0.03 $\text{cm}^{-1}$.

The automatic developing machine for use in the processing of the photographic light-sensitive material of the present invention preferably comprises a means of carrying photographic light-sensitive material as described in JP-A-60-191257, JP-A-60-191258, and JP-A-60-191259. Such a carrying means can exert a high effect of drastically eliminating the amount of the processing solution to be carried from a bath to the following bath to inhibit the deterioration of the properties of the processing solution. This effect can be remarkably exerted for the reduction of the processing time at the various steps and the replenishment rate of the processing solution. In order to reduce the processing time, it is preferred to reduce the crossover time (space time). For example, a method is preferably employed which comprises carrying the photographic light-sensitive material from one step to the subsequent step via a blade having a shielding effect as shown in FIGS. 4, 5 and 6 of JP-A-4-86659 and FIGS. 4 and 5 of JP-A-5-66540.

If the processing solution is concentrated by evaporation in the continuous processing, it is preferred that water be added to correct for concentration.

The processing time at one step as defined herein is meant to indicate the time required from the beginning of the processing of the photographic light-sensitive material at one step until the beginning of the processing of the same photographic light-sensitive material at the subsequent step. The actual processing time in the automatic developing machine is normally determined by the linear speed and the capacity of the processing bath. In the present invention, the standard linear speed is from 500 to 4,000 mm/min. In the case of a small-sized developing machine, the standard linear speed is preferably from 500 to 2,500 mm/min.

The processing time throughout all the processing steps, i.e., from the development step to the drying step is preferably not more than 360 seconds, more preferably not more than 120 seconds, particularly from 30 seconds to 90 seconds. The processing time as used herein is meant to indicate the time required from the beginning of the immersion of the photographic light-sensitive material in the developer until the discharge of the photographic light-sensitive material from the drying zone of the developing machine.

The present invention will be further described in the following examples, but the present invention should not be construed as being limited thereto.

EXAMPLE 1

(Preparation of Photographic Light-sensitive Material)

A paper support laminated with polyethylene on both sides thereof was subjected to corona discharge treatment. An undercoating gelatin layer comprising sodium dodecylbenzenesulfonate was then provided on the corona-discharged surface of the paper support. Various photographic constituent layers were then applied to the undercoating layer to prepare a multi-layer color photographic paper having the following layer configuration. Thus, Sample (100) was obtained.

The coating solutions used had been prepared as follows:

Preparation of 1st layer coating solution 15.0 g of a cyan-coloring coupler (ExC) and 15.8 g of a coloring reducing agent (I-7) were dissolved in a mixture of 52 g of a solvent (Solv-1) and 73 cc of ethyl acetate. The solution thus obtained was then emulsion-dispersed in 420 cc of a 12% aqueous solution containing 10% sodium dedecylbenzene sulfonate and citric acid to prepare an emulsion A.

Separately, a silver bromochloride emulsion A (containing cubic grains having an average size of 0.18 μm and a silver bromide content of 25 mol %) was prepared. This emulsion had a red-sensitive sensitizing dye incorporated therein in an amount of $2.5\times10^{-4}$ mol per mol. The chemical ripening of this emulsion was conducted with a sulfur sensitizer and a gold sensitizer.

The foregoing emulsion A and the foregoing silver bromochloride emulsion A were mixed to make a solution. Then, the 1st layer coating solution was prepared from this solution in such a manner that it had the following composition.

Preparation of 2nd to 7th Layer Coating Solutions

The 2nd to 7th layer coating solutions were prepared in the same manner as in the 1st layer coating solution.

The foregoing various layer coating solutions were then applied to the support to prepare a photographic light-sensitive material sample having the layer configuration described later.

As the gelatin hardener for the various layers there was used sodium salt of 1-oxy-3,5-dichloro-s-triazine.

Cpd-4 and Cpd-5 were incorporated in the various layers in an amount of 25.0 $\text{mg/m}^2$ and 50 $\text{mg/m}^2$, respectively.

The silver bromochloride emulsion for the various light-sensitive emulsion each comprised the following spectral sensitizing dyes incorporated therein.

Red-sensitive Emulsion Layer Sensitizing Dye A-1

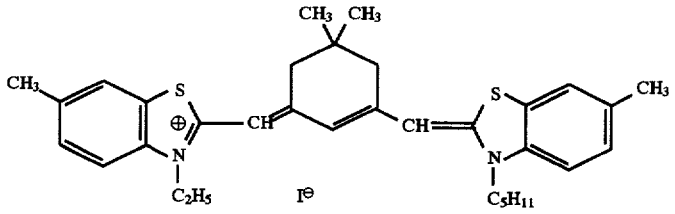

(2.5 × $10^{-4}$ mol per mol of silver halide)

Note: The following compound was incorporated in the layer in an amount of $5\times10^{-3}$ mol per mol of silver halide.

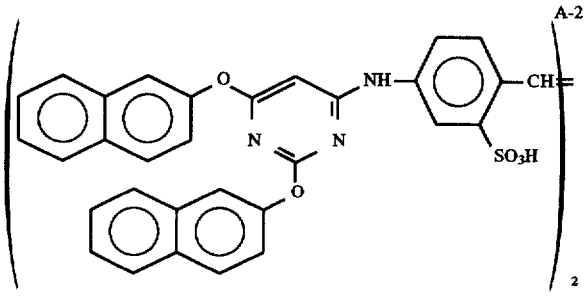

A-2

Green-sensitive Emulsion Layer Sensitizing Dye B

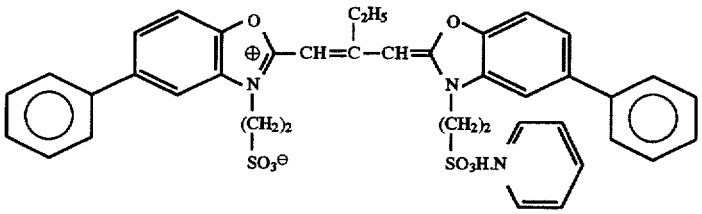

(9.5 × $10^{-4}$ mol per mol of silver halide)

Blue-sensitive Emulsion Layer Sensitizing Dye C

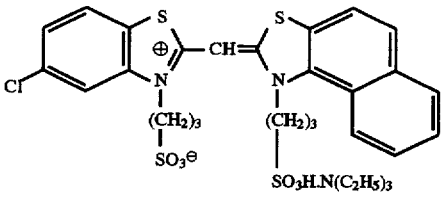

(3.0 × $10^{-4}$ mol per mol of silver halide)

1-(5-Methylureidephenyl)-5-mercaptotetrazole was incorporated in the red-sensitive emulsion layer, green-sensitive emulsion layer and blue-sensitive emulsion layer in an amount of $3.0\times10^{-4}$ mol, $2.0\times10^{-4}$ mol and $8.0\times10^{-4}$ mol per mol of silver halide, respectively.

4-Hydroxy-6-methyl-1,3,3a,7-tetrazaindene was incorporated in the blue-sensitive emulsion layer and green-sensitive emulsion layer in an amount of $1\times10^{-4}$ mol and $2\times10^{-4}$ mol per mol of silver halide, respectively.

In order to inhibit irradiation, the following dyes were incorporated in these emulsion layers (the figure in parentheses indicates the coated amount).

Anti-irradiation dye

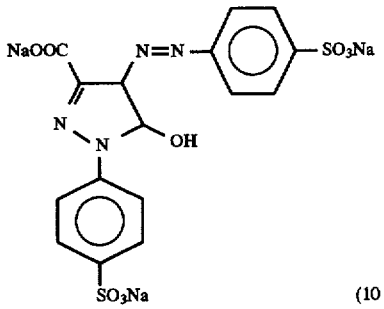

(10 mg/m²)

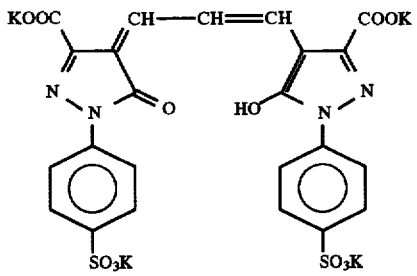

(10 mg/m²)

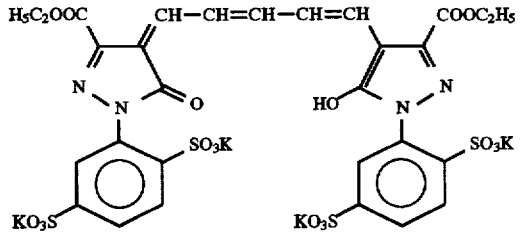

(40 mg/m²)

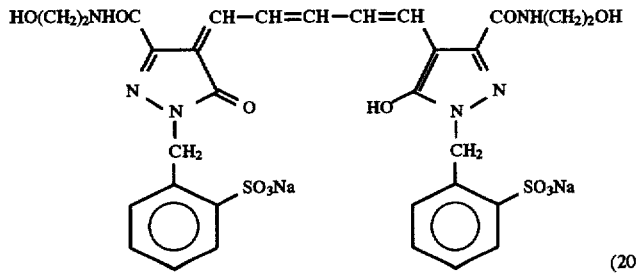

(20 mg/m²)

(Layer Configuration)

The formulation of the various layers will be given below. The figures indicate the coated amount (g/m²). The coated amount of silver halide emulsion is given in silver equivalence.

Support

Polyethylene-laminated paper containing a white pigment ($TiO_2$) and a bluish dye (ultramarine) in the polyethylene on the 1st layer side

| 1st layer (red-sensitive emulsion layer) | |
|---|---|
| Silver bromochloride emulsion A | 0.010 |
| Gelatin | 1.18 |
| Cyan coupler (ExC) | 0.19 |
| Coloring reducing agent (I-9) | 0.20 |
| Solvent (Solv-1) | 0.78 |

-continued

| 2nd layer (color stain-inhibiting layer) | |
|---|---|
| Gelatin | 1.00 |
| Color stain inhibitor (Cpd-1) | 0.08 |
| Solvent (Solv-1) | 0.25 |
| Solvent (Solv-2) | 0.15 |
| Solvent (Solv-3) | 0.13 |
| **3rd layer (green-sensitive emulsion layer)** | |
| Silver bromochloride emulsion (containing cubic grains having an average size of 0.12 μm and a silver bromide content of 25 mol %) | 0.010 |
| Gelatin | 1.25 |
| Magenta coupler (ExC) | 0.26 |
| Coloring reducing agent (I-9) | 0.22 |
| Solvent (Solv-4) | 0.78 |
| **4th layer (color stain-inhibiting layer)** | |
| Gelatin | 1.00 |
| Color stain inhibitor (Cpd-1) | 0.08 |

-continued

| | |
|---|---|
| Solvent (Solv-1) | 0.25 |
| Solvent (Solv-2) | 0.15 |
| Solvent (Solv-3) | 0.13 |
| 5th layer (blue-sensitive emulsion layer) | |
| Silver bromochloride emulsion (containing cubic grains having an average size of 0.41 μm and a silver bromide content of 0.3 mol %) | 0.015 |
| Gelatin | 1.26 |
| Yellow coupler (ExC) | 0.24 |
| Coloring reducing agent (I-9) | 0.24 |
| Solvent (Solv-1) | 0.78 |
| 6th layer (ultraviolet-absorbing layer) | |
| Gelatin | 0.60 |
| Ultraviolet absorbent (UV-1) | 0.57 |
| Dye image stabilizer (Cpd-2) | 0.06 |
| Solvent | 0.05 |
| 7th layer (protective layer) | |
| Gelatin | 1.00 |
| Acryl-modified polymer of polyvinyl alcohol (modification degree: 17%) | 0.05 |
| Liquid paraffin | 0.02 |
| Surface active agent (Cpd-3) | 0.01 |

Yellow coupler (ExY)

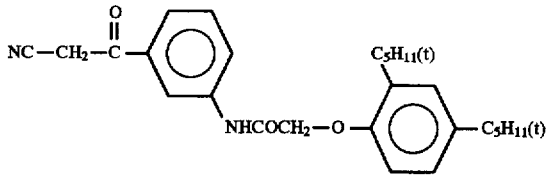

Magenta coupler (ExM)

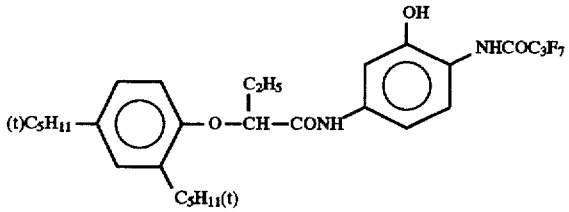

Cyan coupler (ExC)

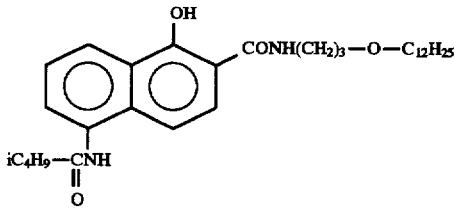

Solvent (Solv-1)

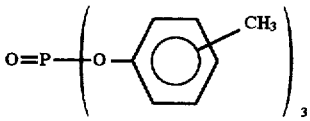

Solvent (Solv-2)

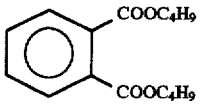

-continued

Solvent (Solv-3)

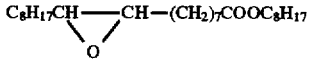

Solvent (Solv-4)

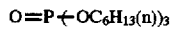

Color stain inhibitor (Cpd-1)

1/1/1 (by weight) mixture of:

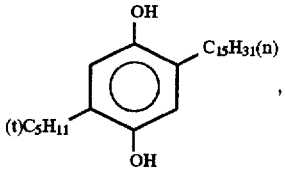

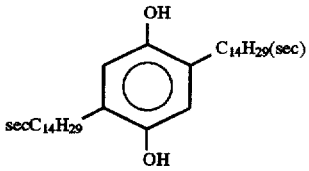

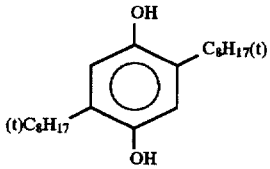

Dye image stabilizer (Cpd-2)

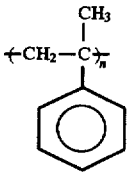

Number-average molecular weight: 600

Surface active agent (Cpd-3)

2/1/1 (by weight) mixture of:

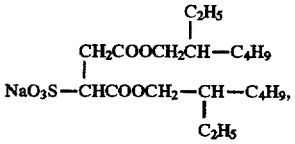

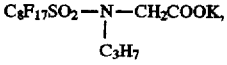

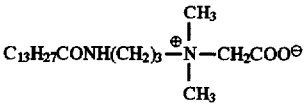

-continued

Preservative (Cpd-4)

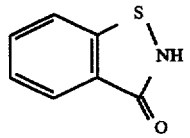

Preservative (Cpd-5)

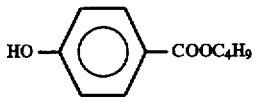

Ultraviolet absorbent (UV-1)

1/2/2/3/1 (by weight) mixture of:

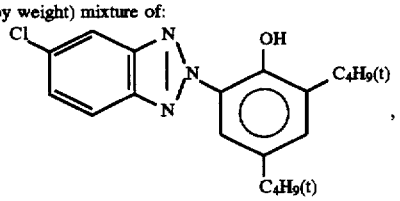

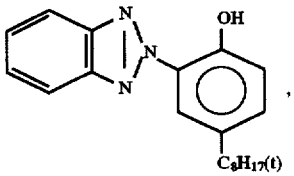

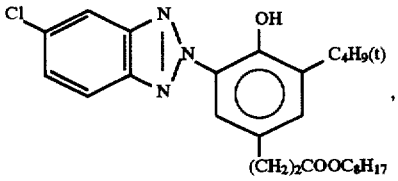

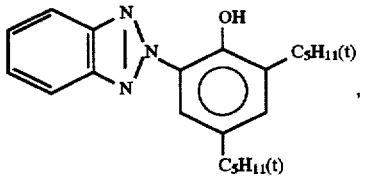

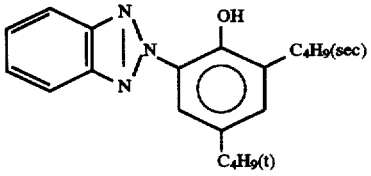

The samples thus prepared were each slit. These samples were each subjected to gradationwise exposure through a three color separation filter for sensitometry using a sensitometer (Type FW, available from Fuji Photo Film Co., Ltd.; color temperature of light source: 3,200° K).

The sample which had been exposed was then subjected to the following processing procedures with the following processing compositions:

| Processing step | Temperature (°C.) | Time (sec) |
|---|---|---|
| Development intensification | 40 | shown in Table 1 |
| Stabilization | 30 | 15 |
| Alkaline treatment | room temperature | 10 |
| Drying | 70 | 15 |

| Development intensifier | |
|---|---|
| Water | 800 ml |
| Tripotassium phosphate | 40.0 g |
| Disodium-N,N-bis (sulfonateethyl) hydroxylamine | 3.3 g |
| Potassium chloride | 2.5 g |
| Hydroxyethylidene-1,1-diphosphone acid (30% solution) | 4 ml |
| 1-Phenyl-4-methyl-4-hydroxymethyl-3-pyrazolidone | 1.0 g |
| Water to make | 1 l |
| pH | 11.7 |

10 ml of hydrogen peroxide (30%) was added to the development intensifier before processing. (The pH value of the development intensifier to which hydrogen peroxide has been added is 11.5.)

| Stabilizer | |
|---|---|
| Sodium hydrogensulfite | 9.0 g |
| Sodium sulfite | 7.8 g |
| Tripotassium citrate monohydrate | 30.0 g |
| Sodium thiosulfate | 7.5 g |
| Water to make | 1 l |
| pH | 6.0 |
| **Alkaline solution** | |
| Potassium carbonate | 30.0 g |
| Water to make | 1 l |
| pH | 10.0 |

The foregoing processing procedure was followed except that the development intensifier had no hydrogen peroxide incorporated therein.

The yellow, magenta and cyan image thus obtained were measured for density through corresponding B, G and R filters, respectively. Thus, the minimum density (Dmin) and maximum density (Dmax) of each color image were measured. The results are set forth in Table 1.

TABLE 1

| No. | Sample No. | Formulation of development intensifier $H_2O_2$ (30%) per l (ml) | Development intensification time (sec) | Cyan density Dmax | Cyan density Dmin | Magenta density Dmax | Magenta density Dmin | Yellow density Dmax | Yellow density Dmin |
|---|---|---|---|---|---|---|---|---|---|
| 1* | (100) | none | 30 | 0.28 | 0.10 | 0.39 | 0.09 | 0.37 | 0.10 |
| 2* | (100) | none | 40 | 0.30 | 0.11 | 0.40 | 0.09 | 0.37 | 0.10 |
| 3* | (100) | none | 50 | 0.30 | 0.11 | 0.40 | 0.09 | 0.37 | 0.10 |
| 4 | (100) | 10 | 30 | 1.53 | 0.12 | 1.97 | 0.10 | 1.79 | 0.12 |
| 5 | (100) | 10 | 40 | 1.55 | 0.12 | 2.00 | 0.10 | 1.80 | 0.12 |
| 6 | (100) | 10 | 50 | 1.57 | 0.12 | 2.02 | 0.10 | 1.80 | 0.12 |

Note:
*Nos. 1, 2 and 3 are comparative examples and the others are the present invention.

The above results show that the processing with the development intensifier of the present invention containing hydrogen peroxide can provide an image with a low minimum density and a high maximum density in a short period of time while the processing with an alkali solution free of hydrogen peroxide provides a very low maximum density.

Further, a good quality image with little color stain and free of stain was obtained.

EXAMPLE 2

Sample (100) of Example 1 was used. The procedure of processing and evaluation of Example 1 were followed except that a gray wedge for sensitometry was used. The results are set forth in Table 2.

TABLE 2

| No. | Sample No. | Formulation of development $H_2O_2$ (30%) per l (ml) | Development intensification time (sec) | Cyan density Dmax | Magenta density Dmax | Yellow density Dmax |
|---|---|---|---|---|---|---|
| 7 | (100) | 10 | 30 | 1.55 | 2.28 | 2.04 |
| 8 | (100) | 10 | 40 | 1.58 | 2.30 | 2.06 |
| 9 | (100) | 10 | 50 | 1.60 | 2.32 | 2.06 |

Note:
Nos. 7, 8 and 9 are the present invention.

The above results show that a high density can be obtained similarly to the density obtained by three color separation of Example 1 without retarding the image density of the lowermost layer (RL) with respect to the color density of the upper layer (BL) in the gray area. On the contrary, the development intensification method with an ordinary p-phenylenediamine color developing agent as described in JP-A-3-111844 provides a drastic drop in the lowermost layer density obtained by gray exposure when processed in a short period of time.

EXAMPLE 3

Sample (200) was prepared in the same manner as in Sample (100) of Example 1 except that the 2nd and 4th interlayers comprised an auxiliary developing agent (ETA-19) incorporated therein in the form of fine solid dispersion in an amount of $1.4\times10^{-4}$ mol per $m^2$.

Sample (200) thus obtained was then subjected to exposure for three color separation in the same manner as in Example 1.

The sample which had been exposed was then subjected to the following processing procedures with the following processing compositions:

| Processing step | Temperature (°C.) | Time (sec) |
|---|---|---|
| Development intensification | 40 | 40 |
| Stabilization | 30 | 15 |
| Alkaline treatment | room temperature | 10 |
| Drying | 70 | 15 |

-continued

| | |
|---|---|
| Development intensifier | |
| Water | 800 ml |
| Tripotassium phosphate | 40.0 g |
| 5-Nitrobenzotriazole | 3.3 g |
| Disodium-N,N-bis (sulfonateethyl) hydroxylamine | 3.3 g |
| Potassium chloride | 2.5 g |
| Hydroxyethylidene-1,1-diphosphonic acid (30% solution) | 4 ml |
| Hydrogen peroxide (30% aqueous solution) | 10 ml |
| Water to make | 1 l |
| pH | 11.5 |
| Stabilizer | |
| Sodium hydrogensulfite | 9.0 g |
| Sodium sulfite | 7.8 g |
| Tripotassium citrate monohydrate | 30.0 g |
| Sodium 2-mercaptobenzimidazole-5-sulfone | 1.0 g |
| Water to make | 1 l |
| pH | 6.0 |

-continued

| Alkaline solution | |
|---|---|
| Potassium carbonate | 30.0 g |
| Water to make | 1 l |
| pH | 10.0 |

The yellow, magenta and cyan images thus obtained were each measured for minimum density and maximum density in the same manner as in Example 1. The degree of color stain was represented by the R photometric density at a magenta density of 1.0. The results are set forth in Table 3.

TABLE 3

| | Sample | Cyan density | | Magenta density | | Yellow density | | Color |
|---|---|---|---|---|---|---|---|---|
| No. | No. | Dmax | Dmin | Dmax | Dmin | Dmax | Dmin | stain |
| 11 | (200) | 1.60 | 0.12 | 2.12 | 0.10 | 1.92 | 0.12 | 0.15 |
| 5 | (100) | 1.55 | 0.12 | 2.02 | 0.10 | 1.80 | 0.12 | 0.20 |

Note:
*Nos. 11 and 5 are the present invention.

When an auxiliary developing agent was incorporated in the light-sensitive material (Sample (200)), an image having a high maximum density was obtained by a short time processing. It was also found that Sample (200) gives an image having a higher density and less color stain than obtained by the development intensification with Sample (100). Further, the development intensifier of the present invention, which is free of auxiliary developing agent, provided similar results even after a week of ageing. Thus, the development intensifier of the present invention exhibits an enhanced stability.

EXAMPLE 4

Samples (201), (202), (203), (204), (205) and (206) were prepared in the same manner as Sample (200) of Example 3 except that the coloring reducing agent to be incorporated in RL layer was replaced by the equimolar amount of (I-1), (I-10), (I-13), (I-30), (I-31) and (I-33), respectively. These samples were then each processed in the same manner as in Example 3 except that the development intensifier was free of hydrogen peroxide. These samples were then each evaluated in the same manner as in Example 3. The results are set forth in Table 4.

TABLE 4

| | Sample | Coloring reducing | development intensifier $H_2O_2$ (30%) per l | Cyan density | |
|---|---|---|---|---|---|
| No. | No. | agent | (ml) | Dmax | Dmin |
| 12 | (201) | I-1 | 10 | 1.57 | 0.13 |
| 13* | (201) | I-1 | none | 0.30 | 0.10 |
| 14 | (202) | I-10 | 10 | 1.54 | 0.12 |
| 15* | (202) | I-10 | none | 0.30 | 0.10 |
| 16 | (203) | I-13 | 10 | 0.95 | 0.09 |
| 17* | (203) | I-13 | none | 0.20 | 0.07 |
| 18 | (204) | I-30 | 10 | 1.60 | 0.13 |
| 19* | (204) | I-30 | none | 0.31 | 0.10 |
| 20 | (205) | I-31 | 10 | 1.62 | 0.13 |
| 21* | (205) | I-31 | none | 0.34 | 0.10 |
| 22 | (206) | I-33 | 10 | 1.62 | 0.13 |
| 23* | (206) | I-33 | none | 0.35 | 0.10 |

TABLE 4-continued

| | Sample | Coloring reducing | development intensifier $H_2O_2$ (30%) per l | Cyan density | |
|---|---|---|---|---|---|
| No. | No. | agent | (ml) | Dmax | Dmin |

Note:
Nos. 13, 15, 17, 19, 21 and 23 are comparative examples and the others are the present invention.

The results show that an image having a high maximum density was obtained even with a photographic light-sensitive material having a drastically reduced silver content similarly to the coloring reducing agent of Example 3. Further, an image with little stain and color stain was obtained.

EXAMPLE 5

Samples (207), (208), (209), (210), (211) and (212) were prepared in the same manner as Sample (200) of Example 3 except that the auxiliary developing agent (ETA-19) to be incorporated in the interlayer was replaced by auxiliary developing agents (ETA-20), (ETA-21), (ETA-31), (ETA-38), (ETA-39) and (ETA-40) or precursors thereof, respectively. These samples were then each processed in the same manner as in Example 3 except that the development intensifier was free of hydrogen peroxide. These samples were then each evaluated in the same manner as in Example 3. The results are set forth in Table 5.

TABLE 5

| | Sample | Auxiliary developing | development intensifier $H_2O_2$ (30%) per l | Yellow density | |
|---|---|---|---|---|---|
| No. | No. | agent | (ml) | Dmax | Dmin |
| 24 | (207) | ETA-20 | 10 | 1.90 | 0.11 |
| 25* | (207) | ETA-20 | none | 0.40 | 0.10 |
| 26 | (208) | ETA-21 | 10 | 1.86 | 0.11 |
| 27* | (208) | ETA-21 | none | 0.38 | 0.10 |
| 28 | (209) | ETA-31 | 10 | 1.95 | 0.12 |
| 29* | (209) | ETA-31 | none | 0.42 | 0.10 |
| 30 | (210) | ETA-38 | 10 | 1.84 | 0.11 |
| 31* | (210) | ETA-38 | none | 0.25 | 0.09 |
| 32 | (211) | ETA-39 | 10 | 1.84 | 0.11 |
| 33* | (211) | ETA-39 | none | 0.22 | 0.09 |
| 34 | (212) | ETA-40 | 10 | 1.85 | 0.11 |
| 35* | (212) | ETA-40 | none | 0.24 | 0.09 |

Note:
*Nos. 25, 27, 29, 3, 33 and 35 are comparative examples and the others are the present invention.

The results show that an image having a high maximum density was obtained by an image intensification process with hydrogen peroxide similarly to the auxiliary developing agent of Example 3. Further, an image with little stain and color stain was obtained. In accordance with the present process, an image formation process requiring no bleaching and little or no discharge of silver and providing an excellent processing stability can be realized.

EXAMPLE 6

Sample (300) was prepared in the same manner as Sample (200) of Example 3 except that the coloring reducing agent to be incorporated in the various layers was replaced by I-49 and the yellow, magenta and cyan couplers to be incorporated in the various layers were replaced by (ExY'), (ExM') and (ExC'), respectively.

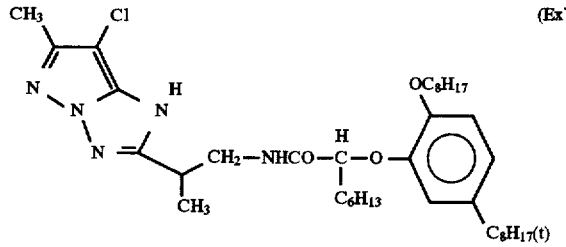

(ExY')

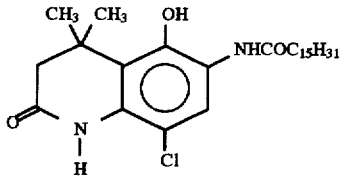

(ExM')

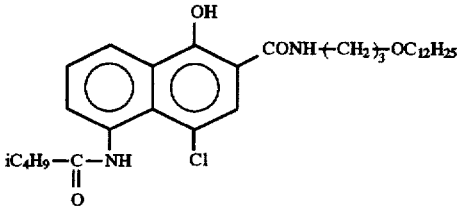

(ExC')

The samples thus prepared were each slit. These samples were each subjected to gradationwise exposure through a three color separation filter for sensitometry using a sensitometer (Type FW, available from Fuji Photo Film Co., Ltd.; color temperature of light source: 3,200° K).

The sample which had been exposed was then subjected to the following processing procedures with the following processing compositions:

| Processing step | Temperature (°C.) | Time (sec) |
|---|---|---|
| Development intensification | 40 | 40 |
| Stabilization | 30 | 15 |
| Drying | 70 | 15 |

| Development intensifier | |
|---|---|
| Water | 800 ml |
| Sodium 5-sulfosalicylate | 29 g |
| Benzotriazole | 10 mg |
| Potassium chloride | 2.5 g |
| Hydroxyethylidene-1,1-diphosphonic acid (30% aqueous solution) | 4 ml |
| Hydrogen peroxide (30% aqueous solution) | 10 ml |

-continued

| | |
|---|---|
| Water to make | 1 l |
| pH | 11.5 |
| Stabilizing solution | |
| Potassium carbonate | 15 g |
| Sodium 2-mercaptobenzimidazole-5-sulfonate | 1 g |
| Hydroxyethylidene-1,1-diphosphonic acid (30% aqueous solution) | 1 ml |
| 5-Chloro-2-methyl-4-isothiazoline-3-one | 0.02 g |
| Water to make | 1 l |
| pH | 9.5 |

These samples were each then processed in the same manner as in Example 3 except that the development intensifier was free of hydrogen peroxide.

The yellow, magenta and cyan image thus obtained were measured for density through corresponding B, G and R filters, respectively. Thus, the minimum density (Dmin) and maximum density (Dmax) of each color image were measured. The results are set forth in Table 6.

TABLE 6

| | Sample | Formulation of development intensifier $H_2O_2$ (30%) per 1 | Cyan density | | Magenta density | | Yellow density | |
|---|---|---|---|---|---|---|---|---|
| No. | No. | (ml) | Dmax | Dmin | Dmax | Dmin | Dmax | Dmin |
| 36* | (300) | none | 0.30 | 0.10 | 0.40 | 0.09 | 0.36 | 0.10 |
| 37 | (300) | 10 | 1.65 | 0.13 | 2.07 | 0.10 | 1.90 | 0.12 |

Note:
*No. 36 is a comparative example and No. 37 is the present invention.

The above results show that the processing with the development intensifier of the present invention containing hydrogen peroxide can provide an image with a low minimum density and a high maximum density in a short period of time while the processing with an alkali solution free of hydrogen peroxide provides a very low maximum density.

Further, a good quality image with little color stain and free of stain was obtained.

EXAMPLE 7

Samples (301), (302), (303), (304), (305) and (306) were prepared in the same manner as Sample (300) of Example 6 except that the coloring reducing agent (I-49) to be incorporated in RL layer was replaced by (I-36), (I-37), (I-44), (I-50), (I-53) and (I-56), respectively.

These samples were then each processed in the same manner as in Example 6 except that the development intensifier was free of hydrogen peroxide. These samples were then each evaluated in the same manner as in Example 6. The results are set forth in Table 7.

TABLE 7

| No. | Sample No. | Coloring reducing agent | development intensifier $H_2O_2$ (30%) per l (ml) | Cyan density Dmax | Dmin |
|---|---|---|---|---|---|
| 38 | (301) | I-36 | 10 | 1.70 | 0.14 |
| 39* | (301) | I-36 | none | 0.32 | 0.11 |
| 40 | (302) | I-37 | 10 | 1.68 | 0.14 |
| 41* | (302) | I-37 | none | 0.32 | 0.11 |
| 42 | (303) | I-44 | 10 | 1.65 | 0.13 |
| 43* | (303) | I-44 | none | 0.31 | 0.11 |
| 44 | (304) | I-50 | 10 | 1.63 | 0.12 |
| 45* | (304) | I-50 | none | 0.30 | 0.11 |
| 46 | (305) | I-53 | 10 | 1.65 | 0.13 |
| 47* | (305) | I-53 | none | 0.31 | 0.10 |
| 48 | (306) | I-56 | 10 | 1.66 | 0.15 |
| 49* | (306) | I-56 | none | 0.30 | 0.11 |

Note:
*Nos. 39, 41, 43, 45, 47 and 49 are comparative examples and the others are the present invention.

The above results show that an image with high density can be obtained even if a light-sensitive material having an extremely low silver halide content, as similar to the case of coloring reducing agent in Example 6. Further, an image with little stain and color stain was obtained.

EXAMPLE 8

Samples (200) to (206) prepared in Examples 3 and 4 and Samples (300) to (306) prepared in Examples 6 and 7 were stored at a temperature of 40° C. and a humidity of 70% for 5 days, and then subjected to graduationwise exposure and processing in the same manner as in Example 6. The samples thus processed were measured for density in the same manner as in Example 6. The results showed that the cyan maximum density was changed. The results are shown in Table 8. ΔDmax in Table 8 means the difference between Dmax before storage and Dmax after storage.

TABLE 8

| No. | ΔDmax |
|---|---|
| (200) | 0.20 |
| (201) | 0.25 |
| (202) | 0.20 |
| (203) | 0.21 |
| (204) | 0.45 |
| (205) | 0.35 |
| (206) | 0.33 |
| (300) | 0.02 |
| (301) | 0.12 |
| (302) | 0.08 |
| (303) | 0.10 |
| (304) | 0.01 |
| (305) | 0.00 |
| (306) | 0.04 |

The above results show that when a carbamoylhydrazine coloring reducing agent is used (Sample (300) to (306)), an image exhibiting low decrease in maximum density is advantageously obtained.

The present process, which employs a development intensifier substantially free of reducing agent, provides an excellent liquid stability and thus gives an image having a high density with a good processing reproducibility as compared with the prior art image intensification process with a development intensifier containing a color developing agent and hydrogen peroxide. At the same time, an image with little stain and color stain can be obtained. In the present process, an image formation process requiring no bleaching and little or no silver discharge and providing an excellent processing stability can be realized. Furthermore, it is preferred to use a carbamoyl coloring reducing agent since the storege property after processing (e.g., supression of reduction in maximum density) is extremely improved.

While the invention has been described in detail and with reference to specific examples thereof, it will be apparent to one skilled in the art that various changes and modifications can be made therein without departing from the spirit and scope thereof.

What is claimed is:

1. A process for the formation of a color image which comprises the steps of: exposing to light a silver halide light-sensitive material comprising a support having thereon at least one light-sensitive emulsion layer, and developing said light-sensitive material to form a color image, wherein said light-sensitive material comprises at least one dye-forming coupler and at least one coloring reducing agent represented by formula (I) and is intensified with a solution containing hydrogen peroxide or a compound releasing hydrogen peroxide to form an intensified image:

$$R^{11}—NH—NH—X—R^{12} \quad (I)$$

wherein $R^{11}$ represents an aryl group or a heterocyclic group; $R^{12}$ represents an alkyl group, an alkenyl group, an alkynyl group, an aryl group, or a heterocyclic group; and X represents —$SO_2$—, —CO—, —COCO—, —CO—O—, —CO—N($R^{13}$)—, —COCO—O—, —COCO—N($R^{13}$)—, or $SO_2$—N($R^{13}$)—, in which $R^{13}$ represents a hydrogen atom, an alkyl group, an alkenyl group, an alkynyl group, an aryl group, or a heterocyclic group; and wherein a color developing agent is not present in either the light sensitive material or said solution.

2. A process for the formation of a color image as claimed in claim 1, wherein X represents —CO—N($R^{13}$)—.

3. A process for the formation of a color image as claimed in claim 1, wherein the total coated amount of silver contained in all coating layers of said silver halide light-sensitive material is from 0.003 to 0.3 g/$m^2$.

4. A process for the formation of a color image as claimed in claim 1, wherein said silver halide light-sensitive material comprises at least one of an auxiliary developing agent and a precursor thereof.

5. A process for the formation of a color image as claimed in claim 3, wherein said silver halide light-sensitive material comprises at least one of an auxiliary developing agent and a precursor thereof.

6. A process for the formation of a color image as claimed in claim 1, wherein said solution containing hydrogen peroxide or a compound releasing hydrogen peroxide is a developer.

7. A process for the formation of a color image as claimed in claim 6, wherein the content of hydrogen peroxide or a compound releasing hydrogen peroxide in said developer is from 0.005 to 1 mol/l.

8. A process for the formation of a color image as claimed in claim 1, wherein said coloring reducing agent is incorporated in said light-sensitive emulsion layer.

9. A process for the formation of a color image as claimed in claim 1, wherein the content of said coloring reducing agent in said light-sensitive emulsion layer is from $1\times10^{-5}$ mol to $1.0\times10^{-2}$ mol.

10. A process for the formation of a color image as claimed in claim 4, wherein said auxiliary developing agent is a pyrazolidone compound.

11. A process for the formation of a color image as claimed in claim 4, wherein said auxiliary developing agent is incorporated in a light-insensitive layer.

12. A process for the formation of a color image as claimed in claim 4, wherein said solution containing hydrogen peroxide or a compound releasing hydrogen peroxide is free of developing agent.

* * * * *